US009342033B2

(12) United States Patent
Hasegawa et al.

(10) Patent No.: US 9,342,033 B2
(45) Date of Patent: May 17, 2016

(54) IMAGE FORMING APPARATUS WITH DEVELOPER COLLECTING OPERATION

(71) Applicant: CANON KABUSHIKI KAISHA, Tokyo (JP)

(72) Inventors: Hideaki Hasegawa, Suntou-gun (JP); Motoki Adachi, Ashigarakami-gun (JP); Takayoshi Kihara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 13/860,707

(22) Filed: Apr. 11, 2013

(65) Prior Publication Data

US 2013/0279934 A1 Oct. 24, 2013

(30) Foreign Application Priority Data

Apr. 18, 2012 (JP) ..... 2012-094686

(51) Int. Cl.
*G03G 15/00* (2006.01)
*G03G 21/10* (2006.01)
*G03G 15/16* (2006.01)

(52) U.S. Cl.
CPC ..... *G03G 21/10* (2013.01); *G03G 15/161* (2013.01); *G03G 15/166* (2013.01); *G03G 2215/0132* (2013.01)

(58) Field of Classification Search
CPC ..... G03G 21/10; G03G 15/161; G03G 2215/1647; G03G 2215/1661; G03G 2221/1823
USPC ..... 399/71, 354
See application file for complete search history.

(56) References Cited

U.S. PATENT DOCUMENTS 6,137,966 A * 10/2000 Uehara et al. ..... 399/13
6,603,941 B2 8/2003 Watanabe et al.
6,611,668 B2 8/2003 Watanabe et al.
6,744,994 B2 6/2004 Yoshikawa et al.
7,498,107 B2 * 3/2009 Takegawa ..... 430/56

(Continued)

FOREIGN PATENT DOCUMENTS

JP 2002-162837 A 6/2002
JP 2004-109798 A 4/2004

(Continued)

OTHER PUBLICATIONS

Machine translation of JP2010-117730.*

*Primary Examiner* — David Gray
*Assistant Examiner* — Andrew V Do
(74) *Attorney, Agent, or Firm* — Fitzpatrick, Cella, Harper & Scinto

(57) ABSTRACT

An image forming apparatus including: image forming stations each including: a photosensitive drum; a charger configured to charge the drum; a transfer device configured to transfer a developer image on the drum onto an intermediate transfer member; and a cleaner configured to remove developer from the drum; an exposure device configured to expose the drum to form a latent image; the intermediate transfer member; a memory storing information on the drum; and a controller configured to control at least one of the charger, transfer device, and exposure device in the station based on the information in the memory to provide a predetermined potential difference between the drum and the transfer device to form an electric field therebetween in a reverse direction to that in an image formation in order to move the developer from the intermediate transfer member to the drum to collect the developer by the cleaner.

13 Claims, 16 Drawing Sheets

(56) References Cited

U.S. PATENT DOCUMENTS

| | | | | |
|---|---|---|---|---|
| 8,275,279 | B2 | 9/2012 | Naito et al. | |
| 8,693,904 | B2 * | 4/2014 | Ishizumi et al. | 399/50 |
| 2003/0175040 | A1 * | 9/2003 | Ogata et al. | 399/55 |
| 2013/0017007 | A1 | 1/2013 | Naito et al. | |

FOREIGN PATENT DOCUMENTS

| | | | |
|---|---|---|---|
| JP | 2010-117730 | A | 5/2010 |
| JP | 2010-224402 | A | 10/2010 |

* cited by examiner

IMAGE FORMING APPARATUS WITH DEVELOPER COLLECTING OPERATION

BACKGROUND OF THE INVENTION

1. Field of the Invention

The present invention relates to an image forming apparatus employing, in general, an electrophotographic printing method, such as a copying machine and a printer.

2. Description of the Related Art

Conventionally, as image forming apparatus employing an electrophotographic printing method, there have been known intermediate transfer type image forming apparatus, in which a toner image formed on an electrophotographic photosensitive member (photosensitive drum) is primarily transferred onto an intermediate transfer member, and the toner image is secondarily transferred onto a recording material (transfer material) to be output.

Of those, various types of in-line type image forming apparatus have been proposed because the in-line type image forming apparatus can form an image at high speed. In the apparatus of this type, a plurality of image forming units configured to form toner images of different colors are arrayed in series in a moving direction of a transfer belt serving as a recording material conveying member (transfer material carrying member) or an intermediate transfer belt serving as an intermediate transfer member. In this configuration, the toner images are sequentially transferred in a superimposed manner from a plurality of photosensitive drums onto the recording material or the intermediate transfer belt.

In such an image forming apparatus, when toner remains or adheres on the surface of the transfer belt or the intermediate transfer belt, cleaning is somehow required because residual toner causes image failure. In order to remove the toner (un-transferred residual toner) remaining or adhering to the surface of the transfer belt or the intermediate transfer belt, there is provided a cleaning device such as a blade which is brought into contact with the transfer belt or the intermediate transfer belt to scrape off the toner. Further, there is proposed a cleaning device which is configured to collect the scraped unnecessary toner into a waste toner tank.

Further, there is also proposed a system in which the above-mentioned cleaning device is not provided, but an un-transferred residual toner collecting electric field is formed at a primary transfer portion so that the un-transferred residual toner on the surface of the transfer belt or the surface of the intermediate transfer belt is electrostatically and reversely transferred onto the photosensitive drum, and the un-transferred residual toner is collected by a cleaning device provided for the photosensitive drum.

In this case, even when the normal charging polarity of the toner is negative (minus), because the un-transferred residual toner is fogging toner or un-secondarily-transferred residual toner, negatively-charged toner and positively-charged (plus) toner are present. Therefore, as for the un-transferred residual toner collecting electric field formed at the primary transfer portion, both of a "transfer electric field" in the same direction as that during image formation and a "reverse transfer electric field" in a direction opposite thereto are necessary.

That is, when the negatively-charged un-transferred residual toner is collected, an exposure unit controls a photosensitive drum surface potential to be in the vicinity of 0 V, and a voltage which is larger on the negative side than that of the photosensitive drum surface is applied to a primary transfer unit. With this, the "reverse transfer electric field" in the direction opposite to that during normal image formation is formed at the primary transfer portion.

On the other hand, when the positively-charged un-transferred residual toner is collected, the photosensitive drum surface is charged to have a negative potential similar to the case during normal image formation, and a positive transfer voltage is applied to the primary transfer unit. With this, the "transfer electric field" in the same direction as the transfer electric field during normal image formation is formed at the primary transfer portion.

Further, there is proposed a method of effectively removing the un-transferred residual toner in the in-line image forming apparatus including a plurality of photosensitive drums to form a plurality of primary transfer portions (Japanese Patent Application Laid-Open No. 2010-117730). In this method, collection is controlled by distinguishing photosensitive drums for collecting the negatively-charged un-transferred residual toner and photosensitive drums for collecting the positively-charged un-transferred residual toner.

Further, it is also proposed in this proposal that, in order to prevent bias in amount of toner to be collected in waste toner containers provided to the respective photosensitive drums, a detection device such as a sensor is provided to the waste toner container, and control of performing distributing collection of the un-transferred residual toner is made in accordance with the detection results. In this case, a control of causing the positively-charged un-transferred residual toner to pass through a predetermined photosensitive drum without being collected is also necessary. In this case, the photosensitive drum surface is exposed with light to form the "reverse transfer electric field" in the direction opposite to that during normal image formation at the primary transfer portion.

Further, a charging device configured to charge the un-transferred residual toner is provided so that the un-transferred residual toner is charged to a predetermined polarity in advance. In this manner, the amount of toner to be reversely transferred onto each photosensitive drum can be controlled and grasped more accurately.

SUMMARY OF THE INVENTION

The present invention is obtained by further developing the above-mentioned related art. The present invention is directed to improve stability of a surface potential of an image bearing member in such an image forming apparatus, and provides an image forming apparatus which includes an image bearing member prevented from being deteriorated in sensitivity over a long-term use, and satisfactorily collects un-transferred residual toner without occurrence of reduction in image density.

According to an embodiment of the present invention, there is provided an image forming apparatus configured to form an image on a recording material, the image forming apparatus including:

a plurality of image forming stations each having:

an image bearing member;

a charging device configured to charge the image bearing member;

a transfer device configured to transfer a developer image formed on the image bearing member onto an intermediate transfer member; and a cleaning device configured to remove developer adhering to the image bearing member;

an exposure device configured to expose the image bearing member with light to form a latent image on the image bearing member;

the intermediate transfer member which is configured to circulate and onto which the developer image formed on the image bearing member is transferred;

a storage portion having information relating to the image bearing member stored therein; and a control portion configured to execute a developer collecting operation of causing the developer adhering to the intermediate transfer member to move to the image bearing member to collect the developer by the cleaning device, wherein the control portion controls, when executing the developer collecting operation, at least one of the charging device, the transfer device, and the exposure device in at least one of the plurality of image forming stations based on the information stored in the storage portion, to provide a predetermined potential difference between the image bearing member and the transfer device and form an electric field between the image bearing member and the transfer device in a direction opposite to a direction of an electric field formed during image formation.

Further, according to another embodiment of the present invention, there is provided an image forming apparatus configured to form an image on a recording material, the image forming apparatus including:

a plurality of image forming stations each having:

an image bearing member;

a charging device configured to charge the image bearing member;

a transfer device configured to transfer a developer image formed on the image bearing member onto the recording material conveyed by a recording material conveying member; and a cleaning device configured to remove developer adhering to the image bearing member;

an exposure device configured to expose the image bearing member with light to form a latent image on the image bearing member;

the recording material conveying member which is configured to circulate and convey the recording material;

a storage portion having information relating to the image bearing member stored therein; and a control portion configured to execute a developer collecting operation of causing the developer adhering to the recording material conveying member to move to the image bearing member to collect the developer by the cleaning device, wherein the control portion controls, when executing the developer collecting operation, at least one of the charging device, the transfer device, and the exposure device in at least one of the plurality of image forming stations based on the information stored in the storage portion, to produce a predetermined potential difference between the image bearing member and the transfer device and form an electric field between the image bearing member and the transfer device in a direction opposite to a direction of an electric field formed during image formation.

Further features of the present invention will become apparent from the following description of exemplary embodiments with reference to the attached drawings.

DESCRIPTION OF THE EMBODIMENTS

First Embodiment

In the following, with reference to the attached drawings, a first embodiment of the present invention will be described in detail.

(1-1) Description of Overall Schematic Configuration of Image Forming Apparatus

Figure 2:
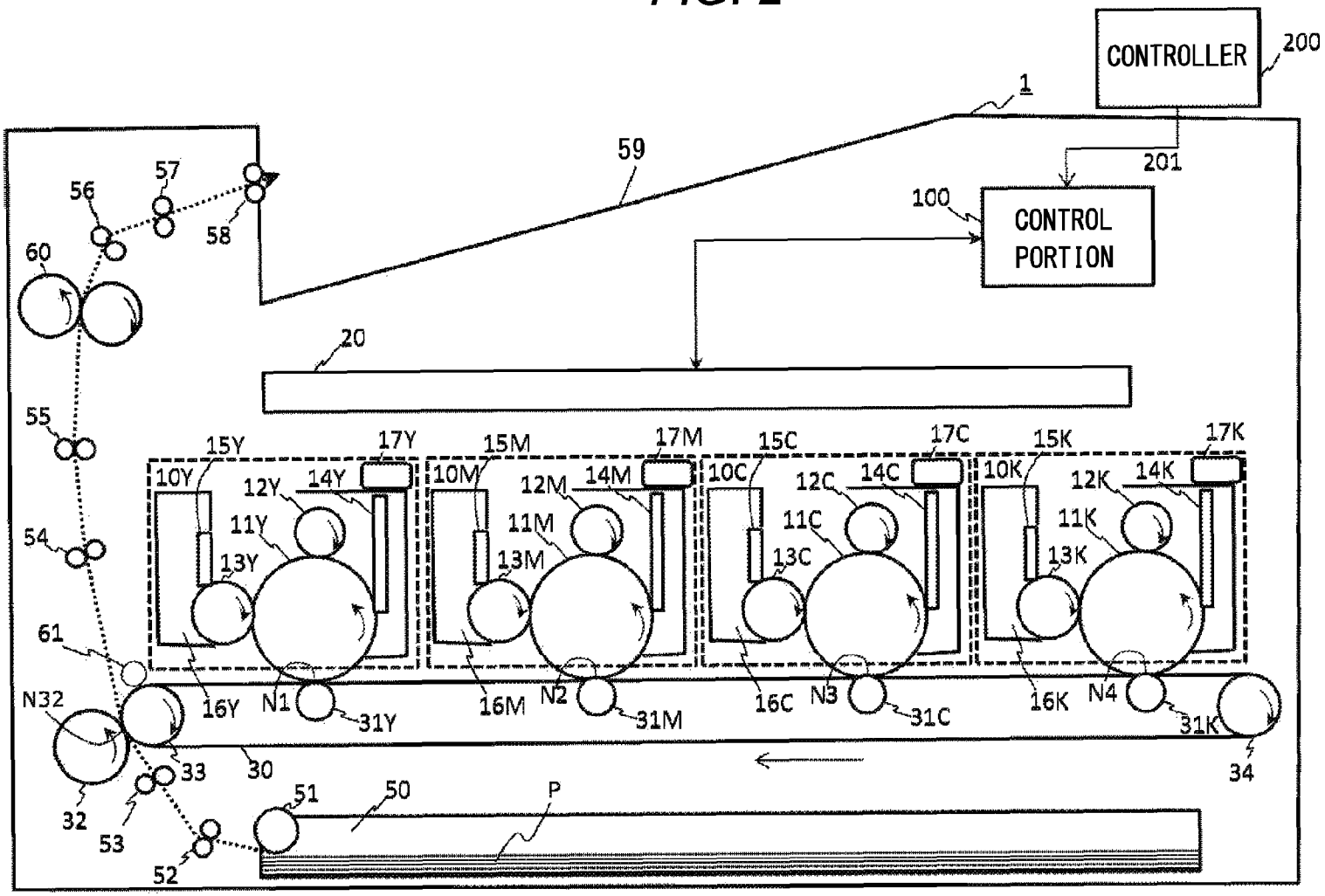
FIG. 2 is a schematic sectional view of an image forming apparatus according to the first embodiment.
Figure 7:
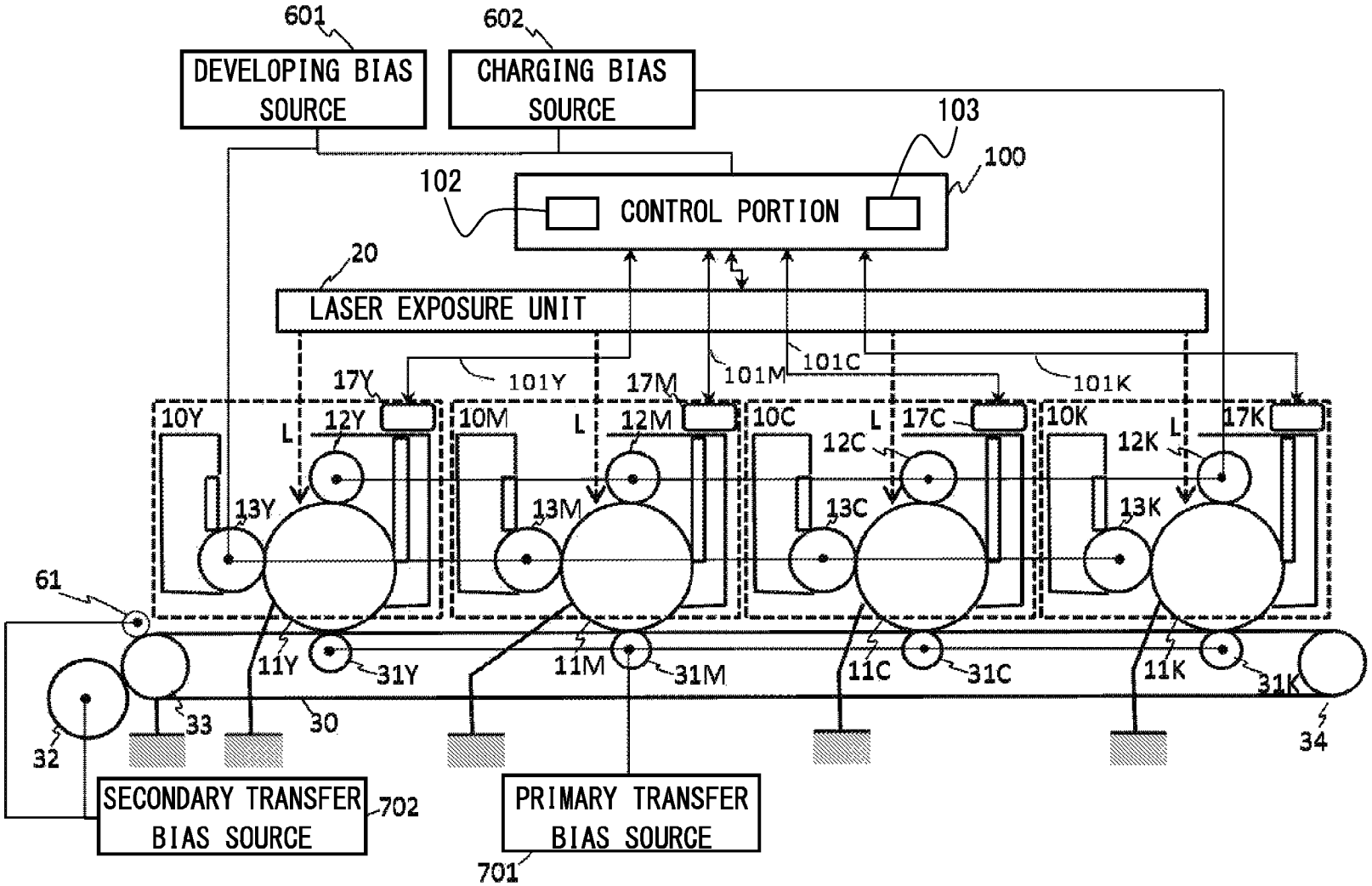
FIG. 7 is a schematic view illustrating power source circuits configured to output a charging bias voltage, a developing bias voltage, a primary transfer bias voltage, and a secondary transfer bias voltage.

In FIG. 2, an image forming apparatus 1 is an intermediate transfer in-line type laser beam printer employing an electrophotographic process. FIG. 7 is a wiring diagram of an application system of a charging bias, a developing bias, a primary transfer bias, and a secondary transfer bias of the image forming apparatus 1. Referring to FIGS. 2 and 7, an overall schematic configuration of the image forming apparatus 1 according to the embodiment will be described.

The image forming apparatus 1 forms an image corresponding to image data (electrical image information) input from a printer controller 200 connected via an interface 201 to a printer control portion 100 onto a recording material (sheet, transfer material) P serving as a recording medium, and outputs an image formation product.

The printer control portion (hereinafter referred to as "control portion") 100 is a control portion configured to control an operation of the image forming apparatus, and exchange various types of electrical information signals with the printer controller 200. Further, the control portion 100 performs processing of electrical information signals input from various types of processing apparatus and sensors, processing of instruction signals to various types of processing apparatus, predetermined initial sequence control, and predetermined imaging sequence control. The control portion 100 includes a laser power control portion 102 and an arithmetic processing portion 103.

The printer controller 200 is an external host apparatus such as a host computer, network, an image reader, and a facsimile machine. The recording material P is recording paper, an OHP sheet, a postcard, an envelope, a label, or the like.

The image forming apparatus 1 has a so-called in-line type configuration in which four image forming units (process cartridges) 10Y, 10M, 10C, and 10K are arranged in parallel to each other at regular intervals in a lateral direction (substantially horizontal direction).

The process cartridges (hereinafter referred to as "cartridges") 10Y, 10M, 10C, and 10K include photosensitive drums 11 (11Y, 11M, 11C, and 11K), respectively, which serve as image bearing members. Further, the process cartridges 10Y, 10M, 10C, and 10K include charging rollers 12 (12Y, 12M, 12C, and 12K), respectively, which serve as charging members (charging devices) configured to uniformly charge the surfaces of the photosensitive drums (hereinafter referred to as "drums") 11 at a predetermined potential.

Further, in the embodiment, non-magnetic one component toner (having negatively charging property) is used as the developer. In order to develop electrostatic latent images formed on the drums 11, the process cartridges 10Y, 10M, 10C, and 10K include developing rollers 13 (13Y, 13M, 13C, and 13K), respectively, which serve as developing members configured to bear and convey toner. Further, the process cartridges 10Y, 10M, 10C, and 10K include developing blades 15 (15Y, 15M, 15C, and 15K), respectively, for achieving uniformity of the toner layers on the developing rollers 13. Further, the process cartridges 10Y, 10M, 10C, and 10K include cleaning devices (cleaning units), respectively, configured to collect toner remaining on the drums 11 after transfer of the toner images, that is, drum cleaners 14 (14Y, 14M, 14C, and 14K), respectively, configured to clean the surfaces of the drums 11.

Each of the cartridges 10Y, 10M, 10C, and 10K is formed of the above-mentioned drum 11, the charging roller 12, the developing roller 13, the developing blade 15, and the drum cleaner 14 in an integrated manner. The drum 11 of each of the cartridges 10Y, 10M, 10C, and 10K is rotationally driven by a drive device (not shown) at a surface moving speed of 120 mm/sec in a direction indicated by the arrow in FIG. 2.

In this case, the respective cartridges 10Y, 10M, 10C, and 10K are configured to be substantially similar to each other except for toner (developer) contained in developing containers 16 (16Y, 16M, 16C, and 16K).

The cartridge 10Y includes the developing container 16Y containing yellow (Y) toner, and forms a yellow toner image (developer image) on the drum 11Y. The cartridge 10M includes the developing container 16M containing magenta (M) toner, and forms a magenta toner image on the drum 11M. The cartridge 10C includes the developing container 16C containing cyan (C) toner, and forms a cyan toner image on the drum 11C. The cartridge 10K includes the developing container 16K containing black (K) toner, and forms a black toner image on the drum 11K.

Each of the cartridges 10Y, 10M, 10C, and 10K are removably (detachably) mounted to a mounting portion of an apparatus main body (image forming apparatus main body) of the image forming apparatus 1. For example, when the toner inside the developing container 16 is consumed, each of the cartridges 10Y, 10M, 10C, and 10K can be replaced independently.

Further, the cartridges 10Y, 10M, 10C, and 10K include memories 17 (17Y, 17M, 17C, and 17K), respectively, which serve as storage devices (storage portions). The memory 17 of arbitrary types may be employed, such as a contact non-volatile memory, a non-contact non-volatile memory, and a volatile memory including a power source. In the embodiment, as the storage device, the non-contact non-volatile memory 17 is mounted on the cartridge 10.

The non-contact non-volatile memory 17 includes an antenna (not shown) which is an information transmitting unit (communication unit) on the memory side. The non-contact non-volatile memory 17 wirelessly communicates with the control portion 100 on the main body side of the image forming apparatus 1, to thereby enable reading and writing of information. That is, the control portion 100 functions as an information transmitting unit (communication unit) on the apparatus main body side and a unit configured to read and write information with respect to the memory 17. In FIG. 7, communication portions 101 (101Y, 101M, 101C, and 101K) are provided between the control portion 100 and the respective memories 17.

Each of the memories 17 stores information relating to the corresponding drum 11 serving as the image bearing member. That is, as described later, information relating to the film thickness of a photosensitive layer of the drum 11 (film thickness information), and information relating to sensitivity (sensitivity information) are stored when the drum 11 or the cartridge is manufactured. Further, information relating to amounts of film thickness change and sensitivity change, exposure history information, and the like along with use of the drum 11 can be written and read as needed.

The developing roller 13 serving as the developing member includes a core metal and a conductive elastic body layer formed concentrically around the core metal, and is arranged substantially parallel to the drum 11. The developing blade 15 is formed of a thin metal plate made of SUS, and has a free end brought into contact with the developing roller 13 at a predetermined pressing force. The developing roller 13 bears and conveys, by friction, negatively-charged toner to a developing position opposed to the drum 11.

In each of the cartridges 10Y, 10M, 10C, and 10K, a developing unit including the developing roller 13, the developing blade 15, and the developing container 16 is arranged swingably with respect to the drum 11. Further, the state of the developing unit is transformed to a contact state in which the developing roller 13 is brought into contact with the drum 11 at a predetermined pressing force and to a separation state in which the developing roller 13 is separated from the drum 11, by a contact-separation mechanism (not shown) controlled by the control portion 100.

During an image forming step, the state of the developing unit is transformed into a state in which the developing roller 13 is brought into contact with the drum 11, and the developing roller 13 is rotated at a predetermined speed in the direction indicated by the arrow. Further, with respect to the core metal of the developing roller 13, a DC bias voltage of about −300 V is applied as a developing bias voltage from a developing bias source 601 (FIG. 7) controlled by the control portion 100.

In the image forming apparatus 1 of the embodiment, as an exposure device configured to expose the surface of the drum 11 with light, a laser exposure unit 20 is provided to expose the drums 11 arranged in the respective cartridges 10 with light. The laser exposure unit 20 inputs a time-series electric digital pixel signal of image information which is input from the printer controller 200 via the interface 201 to the control portion 100 and is subjected to image processing.

Although not illustrated in the figures, the laser exposure unit 20 includes a laser output portion configured to output a laser light modulated in accordance with the input time-series electric digital pixel signal. Further, the laser exposure unit 20 includes a rotary polygon mirror, an fθ lens, and a reflecting mirror.

The laser exposure unit 20 performs main scanning exposure onto the surface of the drum 11 by laser light L. With the main scanning exposure and sub-scanning exposure obtained by rotation of the drum 11 whose surface is uniformly charged by the charging roller 12, an electrostatic latent image corresponding to the image information is formed on the surface of the drum 11.

Further, the laser exposure unit 20 exposes the drum 11 with light also when a remaining toner collecting operation to be described later is executed. In this manner, the drum surface potential is controlled. The remaining toner collecting operation corresponds to an un-transferred residual toner collecting operation of transferring the toner remaining on an intermediate transfer belt 30 onto the drum 11 to collect the toner by the drum cleaner 14.

In this case, the charging roller 12 serving as a contact-type charging device includes a core metal and a conductive elastic body layer formed concentrically around the core metal, and is arranged substantially parallel to the drum 11. Further, the charging roller 12 is brought into contact with the drum 11 against the elastic force of the conductive elastic body layer by a predetermined pressing force. The core metal has both end portions rotatably supported by bearings, and the charging roller 12 rotates in accordance with the rotation of the drum 11. In the embodiment, with respect to the core metal of the charging roller 12, a DC bias voltage of about −1,000 V is applied as a charging bias voltage from a charging bias source 602 (FIG. 7) controlled by the control portion 100.

On the other hand, in the image forming apparatus 1 of the embodiment, the endless intermediate transfer belt (hereinafter referred to as "belt") 30 serving as a second image bearing member is arranged so as to come into contact with the drums 11 of the respective cartridges 10Y, 10M, 10C, and 10K. The belt 30 is an intermediate transfer member which circulates in order that the toner images formed on the drums 11 are primarily transferred on the intermediate transfer member.

The belt 30 is obtained by, as an example, forming a resin film into an endless shape. The resin film is subjected to resistance adjustment as necessary, and has an electric resistance value (volume resistivity) of about $10^{11}$ to $10^{16}$ Ω·cm and a thickness of 100 to 200 μm. The resin film is made of polyvinylidene difluoride (PVDF), nylon, polyethylene terephthalate (PET), polycarbonate (PC), or the like.

Further, the belt 30 is passed over a drive roller 34 and a secondary transfer opposing roller 33, and the drive roller 33 is rotated by a motor (not shown) to be driven to circulate at a process speed. Primary transfer rollers 31 (31Y, 31M, 31C, and 31K) are each formed into a roller shape in which a conductive elastic layer is provided on a shaft, and are arranged substantially parallel to the drums 11 (11Y, 11M, 11C, and 11K), respectively. The primary transfer rollers 31 (31Y, 31M, 31C, and 31K) are brought into contact with the drums 11 across the belt 30 at a predetermined pressing force to form primary transfer portions N1, N2, N3, and N4, respectively.

That is, the primary transfer rollers 31 are a plurality of primary transfer units (primary transfer devices) which form the primary transfer portions N1, N2, N3, and N4 together with the plurality of drums 11 serving as the image bearing members across the belt 30, respectively, and primarily transfer toner images from the drums 11 onto the belt 30 at the respective primary transfer portions. The respective cartridges 10Y, 10M, 10C, and 10K and the respective primary transfer portions N1, N2, N3, and N4 corresponding thereto form image forming stations configured to form toner images of respective colors onto the belt 30.

With respect to the shaft of the primary transfer roller 31, during the image forming step, a positive DC bias voltage of about 300 V is applied as a primary transfer bias voltage from a primary transfer bias source 701 (FIG. 7) controlled by the control portion 100. Further, during an un-secondarily-transferred residual toner collecting operation, a negative DC bias voltage of about −500 V is applied as a bias for forming a reverse transfer electric field. That is, during the un-secondarily-transferred residual toner collecting operation, the control portion 100 controls the primary transfer bias source 701 to generate an electric field between the primary transfer roller 31 and the drum 11 in a direction opposite to that during image formation.

The toner image of each color developed on the drum 11 is sent to the primary transfer portion by further rotating the drum 11 in the direction indicated by the arrow, and is sequentially primarily transferred onto the belt 30 by the transfer electric field formed between the primary transfer roller 31 and the drum 11. At this time, the images of four colors are sequentially transferred onto the belt 30 in a superimposed manner. Therefore, the positions of the toner images of the four colors match with each other. The un-primarily-transferred residual toner on the drum 11 is cleaned by the drum cleaner 14.

Note that, in order to satisfactorily perform the primary transfer process while satisfying conditions such as high transfer efficiency and low retransfer ratio all the time, it is necessary that the positive bias applied from the primary transfer bias source 701 be controlled to an optimum value considering environment, characteristics of parts, and the like all the time. The control portion 100 performs this control.

In this case, the image forming apparatus 1 of the embodiment includes, as a sheet conveying system, on a sheet feeding side, a sheet cassette 50 configured to store the recording materials (hereinafter referred to as "sheets") P. Further, the image forming apparatus 1 includes a pick-up roller 51 configured to pick up and convey the sheets P stacked on the sheet cassette 50 at a predetermined timing, and a conveying roller 52 configured to convey the sheet P fed by the pick-up roller 51. Further, the image forming apparatus 1 includes a registration roller 53 configured to send the sheet P to a secondary transfer position in synchronization with the image formation operation.

When the toner images of the respective four colors are primarily transferred onto the belt 30, in synchronization with the rotation of the belt 30, the sheet P is conveyed from the registration roller 53. Then, a secondary transfer roller 32 configured similarly to the primary transfer roller 31 comes into contact with the belt 30 across the sheet P to form a secondary transfer portion (nip portion) N32, to thereby nip and convey the sheet P. With respect to the secondary transfer roller (secondary transfer device) 32, under a state in which the secondary transfer opposing roller 33 is serving as an opposing electrode, a positive DC bias voltage of about 1,000 V is applied from a secondary transfer bias source 702 (FIG. 7). With this, the toner images of the respective four colors on the belt 30 are collectively secondarily transferred onto the sheet P.

Then, the sheet P having the toner images of the respective four colors transferred thereon by being nipped and conveyed through the secondary transfer portion N32 is separated from the belt 30. Then, by conveying rollers 54 and 55, the sheet P is conveyed to a conventionally known fixing device 60. In the fixing device 60, the unfixed toner images on the sheet P are subjected to fixing processing under heat and pressure to be fixed onto the sheet P. Then, by delivery rollers 56 and 57, the sheet P is discharged as a color image formation product from a delivery port 58 onto a delivery tray 59 on the upper surface of the apparatus main body.

Un-secondarily-transferred residual toner remaining on the belt 30 without being transferred onto the sheet P is reversely-charged into a positive polarity by a brush roller 61 (developer charging member) which is brought into contact with the belt 30 on the downstream side with respect to the secondary transfer portion N32 in the moving direction of the belt 30. That is, with respect to the brush roller 61, a positive DC bias voltage of about 1,000 V, which is the same as the secondary transfer bias, is applied from the secondary transfer bias source 702 (FIG. 7). With the brush roller 61, the un-secondarily-transferred residual toner remaining on the belt 30 is reversely charged into a positive polarity.

Then, the un-secondarily-transferred residual toner reversely charged into a positive polarity is reversely transferred onto the drum 11 at the primary transfer portion, and is scraped by the drum cleaner 14 to be collected. That is, the un-transferred residual toner collecting operation can be executed, in which the toner remaining on the belt 30 is transferred (reversely transferred) onto the photosensitive drum 11 to be collected by the drum cleaner (cleaning device) 14.

(1-2) Description Relating to Un-Transferred Residual Toner Collecting Operation (Remaining Toner Collecting Operation, Developer Collecting Operation)<

Conventional Example

The un-transferred residual toner collecting operation of collecting the toner remaining on the belt 30 by transferring the toner onto the drum 11 to be collected by the drum cleaner 14 will be described with reference to FIGS. 12A and 12B from the viewpoints of sequence and drum potential characteristics. The drum 11 of the example includes a cylindrical base body made of aluminum and an OPC (organic photoconductor) photosensitive layer coating the surface of the cylindrical base body. The photosensitive layer has an initial film thickness of 18 μm.

When the image forming step is started, a DC bias voltage of about −1000 V is applied to the charging roller 12, and a dark section potential of about −500 V is formed on the surface of the drum 11. Based on the image data, the laser exposure unit 20 exposes the drum surface subjected to charging processing with laser power (exposure power: exposure laser power) L1, to thereby form a light section potential of −100 V. With this, on the drum surface, due to an electrostatic contrast between the dark section potential (about −500 V) and the light section potential (−100 V), an electrostatic latent image corresponding to image data is formed.

The electrostatic latent image is developed as a toner image by the developing roller 13. The toner image on the drum is transferred onto the belt 30 by the transfer electric field formed at each of the primary transfer portions N1 to N4 by the DC bias voltage corresponding to the primary transfer bias of 300 V. Then, the toner image on the belt 30 is secondarily transferred onto the sheet P at the secondary transfer portion N32.

After the image formation is completed, the un-secondarily-transferred residual toner collecting operation is continuously executed on the belt 30. Specifically, with the brush roller 61, the positively-charged un-secondarily-transferred residual toner is released onto the belt 30, and is conveyed to the primary transfer portion of the collecting drum (collecting station).

Figure 12A:
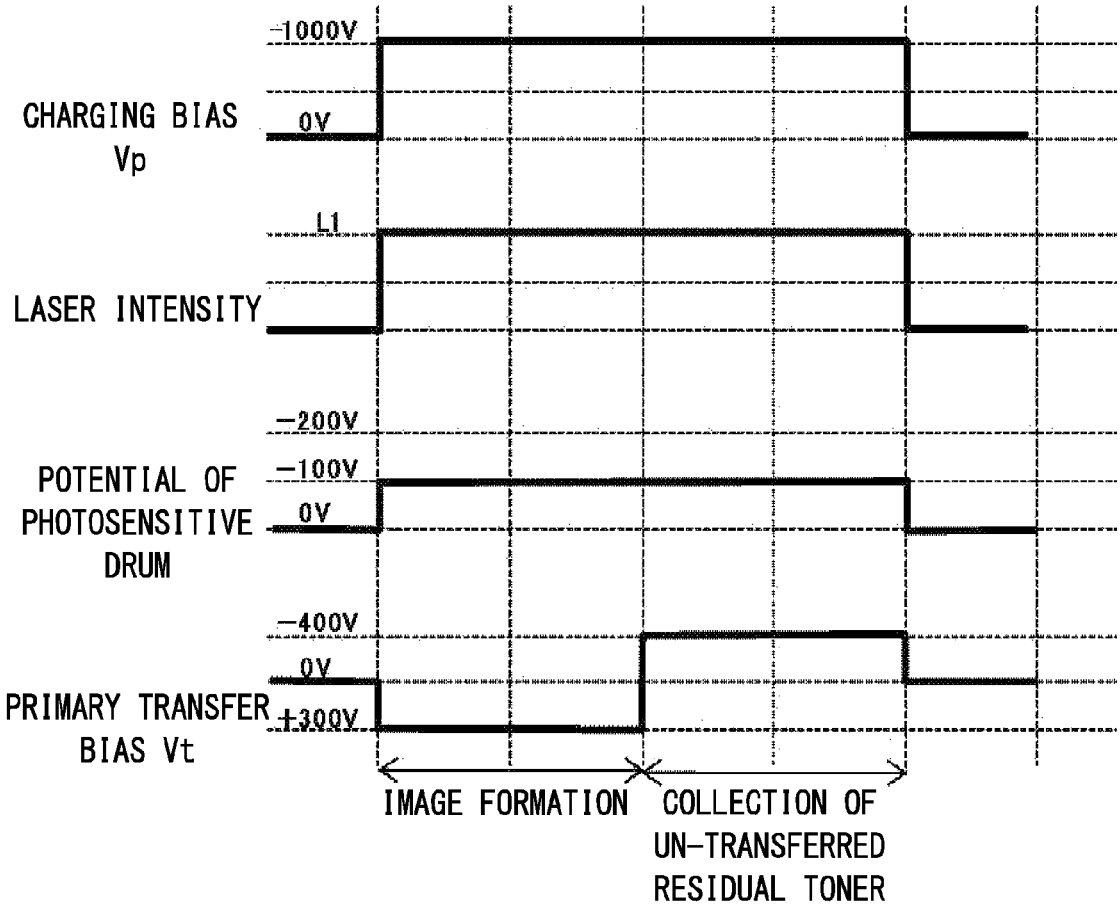
FIG. 12A is a sequence diagram illustrating an un-transferred residual toner collecting operation according to a conventional example.
Figure 12B:
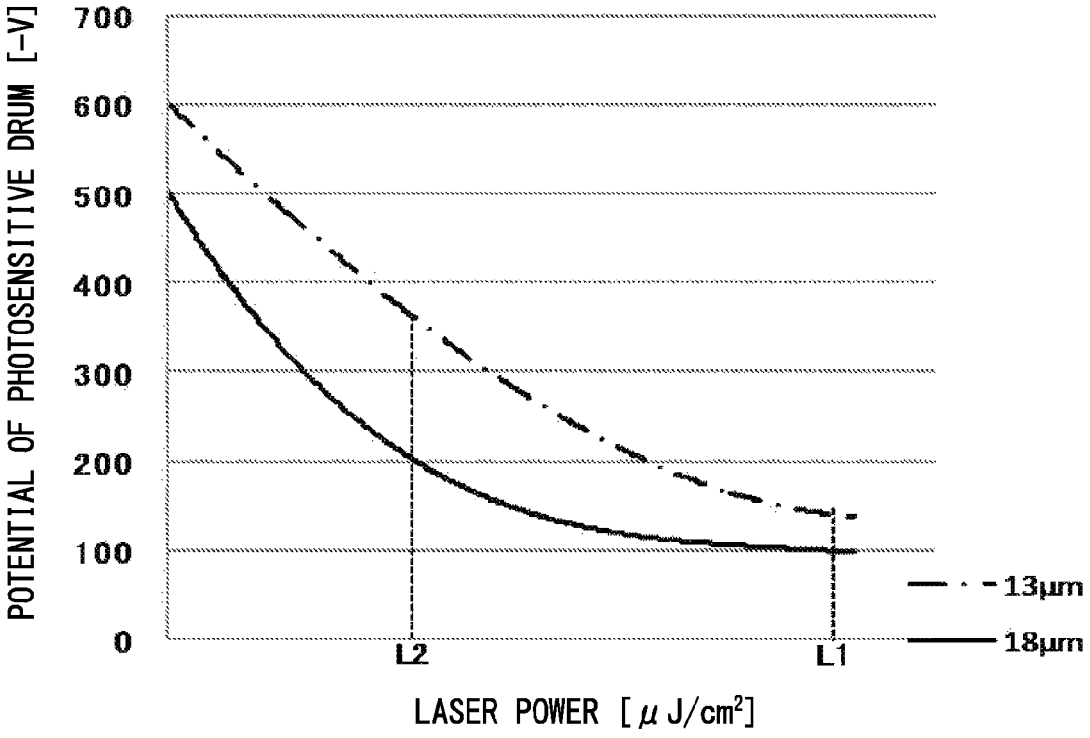
FIG. 12B is a graph showing sensitivity characteristics of a photosensitive drum according to the conventional example.

For example, in a case where the un-transferred residual toner is collected by the drum 11C of the cartridge 10C, in the process of conveyance, when the un-transferred residual toner passes through the primary transfer portions N1 and N2 serving as non-collecting stations through which the un-transferred residual toner is passed without being collected, a sequence illustrated in FIG. 12A is executed.

That is, the laser exposure unit 20 continues exposure of the drums 11Y and 11M at the laser power L1, and a DC bias for forming a reverse transfer electric field of −400 V is applied to the primary transfer rollers 31Y and 31M. With this, the "reverse transfer electric field" of 300 V is formed at the primary transfer portions N1 and N2. With this potential difference, the positively-charged un-transferred residual toner reliably passes through the primary transfer portions N1 and N2 serving as the non-collecting stations.

Further, at the primary transfer portion N3 serving as the collecting station, the charging roller 12C charges the drum 11C to −500 V, and a DC bias of −200 V is applied to the primary transfer roller 31C, to thereby form the "transfer electric field" of 300 V. With this, the positively-charged un-secondarily-transferred residual toner is collected. At this time, in the collecting station, a positive DC bias voltage of 0 V or, similarly to the case of image formation, 300 V may be applied to the primary transfer roller 31C to form the "transfer electric field."

Further, on the other hand, on the brush roller 61, un-transferred residual toner that is not sufficiently charged into the positive polarity (plus) accumulates. Therefore, in some cases, a negative (minus) DC bias voltage is applied to the brush roller 61, to thereby perform so-called brush roller cleaning. In those cases, the negatively-charged un-secondarily-transferred residual toner is released onto the belt 30 to be conveyed to the primary transfer portion of the collecting station, and is reversely transferred onto the drum 11 of the collecting station to be collected.

For example, a case where the negatively-charged (minus) un-secondarily-transferred residual toner is collected by the drum 11K of the cartridge 10K will be described. In this case, in the process of conveyance, when the un-secondarily-transferred residual toner passes through the primary transfer portions N1, N2, and N3 serving as the non-collecting stations through which the un-secondarily-transferred residual toner is passed without being collected, the charging rollers 12Y, 12M, and 12C charge the drums 11Y, 11M, and 11C to −500 V, respectively. Then, a DC bias of −200 V is applied to the primary transfer rollers 31Y, 31M, and 31C. With this, the "transfer electric field" of 300 V is formed, and thus the negatively-charged (minus) un-transferred residual toner is passed therethrough without being collected.

Further, at the primary transfer portion N4 serving as the collecting station, as illustrated in FIG. 12A, the laser exposure unit 20 exposes the drum 11K with the laser power L1, and a DC bias for forming the reverse transfer electric field of −400 V is applied to the primary transfer roller 31K. With this, the "reverse transfer electric field" of 300 V is formed at the primary transfer portion N4. Thus, the negatively-charged (minus) un-transferred residual toner is collected.

It is effective to, as described above, when the reverse transfer electric field is formed in the un-transferred residual toner collecting operation, bring the surface potential of the drum close to 0 V as much as possible to keep the primary transfer bias voltage output value low, so as to reduce the size of the power source and the apparatus. Further, for the purpose of reducing the potential change caused by the film thickness change of the drum as much as possible, it has been common to use strong exposure amount such as the laser power L1.

However, along with the longer operating life of the drum 11, in some cases, the drum 11 subjected to repetitive strong exposure is deteriorated in sensitivity. Specifically, as illustrated in FIG. 12B, when the drum 11 is used until the film thickness reduced from 18 μm to 13 μm, the potential characteristics of the drum 11 are significantly changed. As the sensitivity of the drum 11 is deteriorated, even when the drum 11 is exposed with light, the absolute value of the potential is less liable to decrease (the absolute value of the potential after exposure increases). That is, the light section potential of the drum 11 changes when exposure is performed at the laser power L1, and as a result, there may occur reduction in image density due to reduction in contrast during the image formation, and failure of passage and collection due to reduction of the "reverse transfer electric field" during the un-transferred residual toner collecting operation.

That is, the un-transferred residual toner collecting operation is a sequence which is performed in high frequency every time after the image formation, and exposure is performed for almost the entire image forming region of the drum 11, which have been a dominative cause of sensitivity deterioration of the drum 11. On the other hand, when the exposure amount for the drum surface is set low during formation of the "reverse transfer electric field", the film thickness changes due to abrasion along with the use of the drum 11. Thus, the drum surface potential may change, which makes it difficult to obtain a desired "reverse transfer electric field."

Embodiments

In view of this, in embodiments of the present invention, for the purpose of preventing sensitivity deterioration of the drum 11, the exposure amount for the photosensitive drum is kept low during formation of the "reverse transfer electric field" when the un-transferred residual toner collecting operation (developer collecting operation) is executed. Further, the exposure amount is controlled based on the information of use of the drum 11.

That is, the control portion 100 controls the exposure power of the laser exposure unit (exposure device) 20 in order to obtain a predetermined potential difference between the drum 11 and the primary transfer roller 31 based on the information stored in the memory 17.

Figure 3:
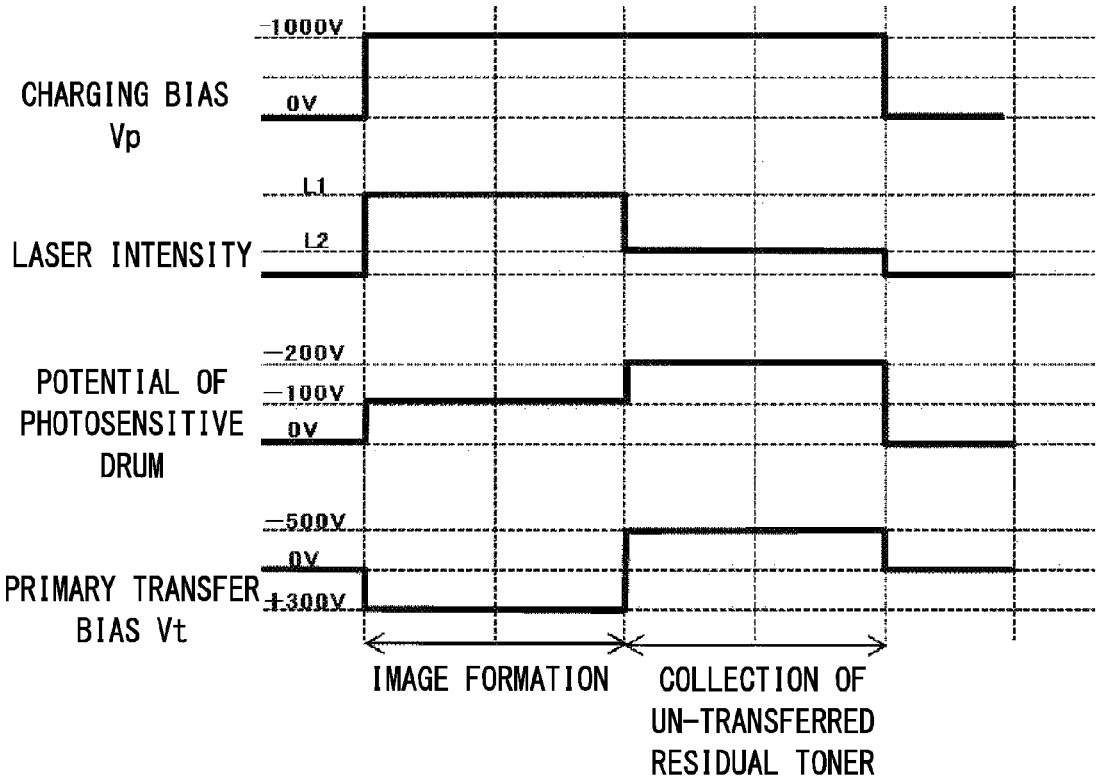
FIG. 3 is a sequence diagram illustrating an un-transferred residual toner collecting operation at an initial stage in use of a photosensitive drum according to the first embodiment.
Figure 4A:
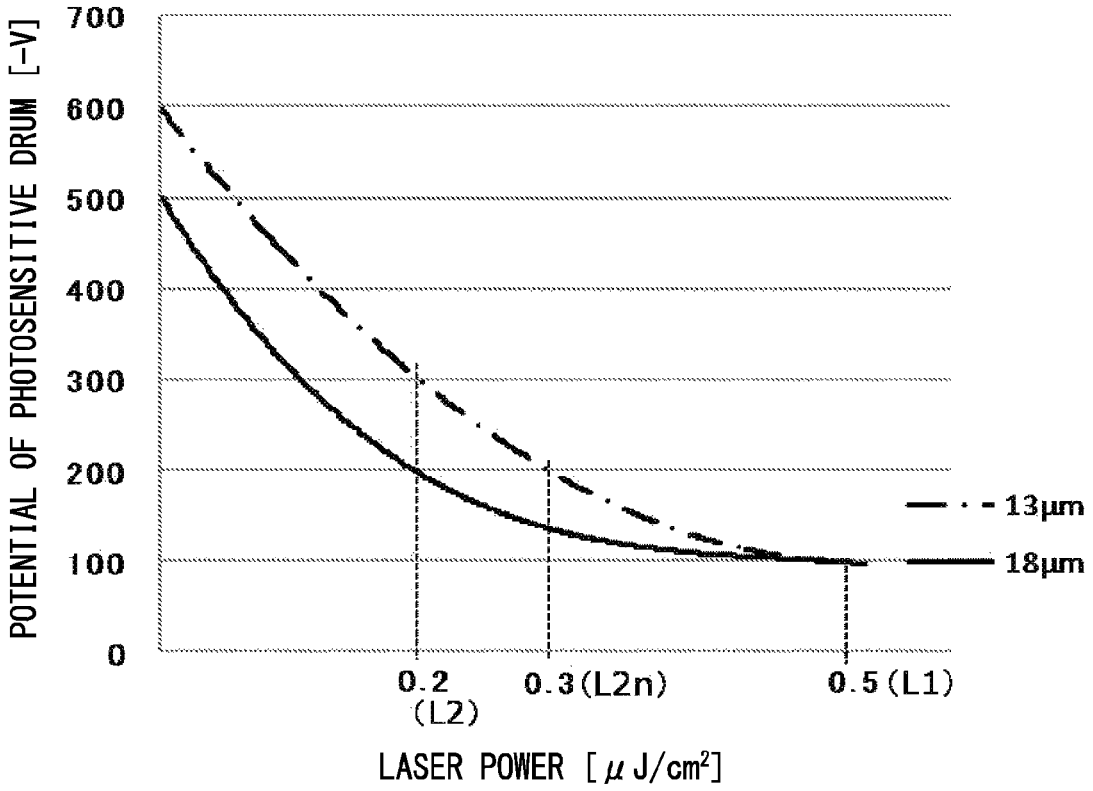
FIG. 4A is a graph showing sensitivity characteristics of the photosensitive drum according to the first embodiment.
Figure 4B:
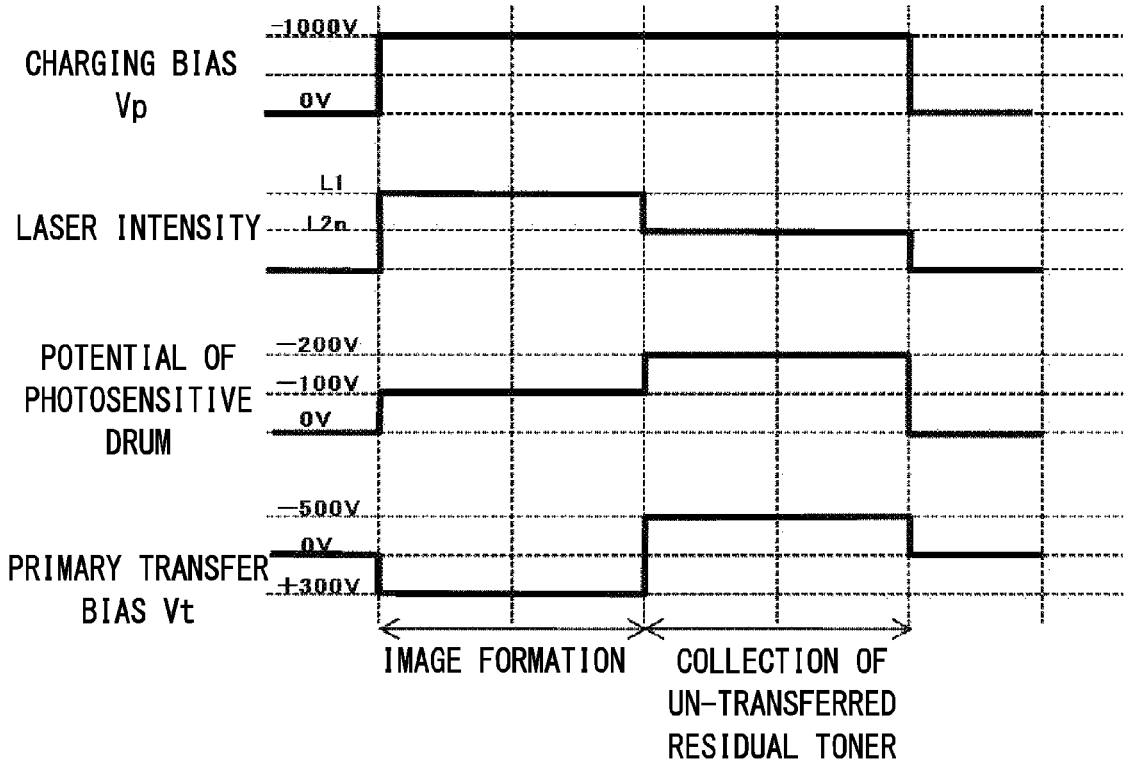
FIG. 4B is a sequence diagram illustrating the un-transferred residual toner collecting operation according to the first embodiment.

Referring to FIGS. 3, 4A, and 4B, from the viewpoints of sequence and drum potential characteristics, a specific description will be provided of the control. In this case, in the state of the initial film thickness of 18 μm, as illustrated in FIGS. 3 and 4A, the exposure amount is set to laser power L2 during formation of the "reverse transfer electric field" in the un-transferred residual toner collecting operation. The laser power L2 is obtained by reducing the laser intensity (exposure amount) from the laser power L1 during image formation so that the drum surface potential (light section potential) becomes −200 V in contrast to −100 V during image formation. At this time, by applying a primary transfer bias voltage of −500 V, the "reverse transfer electric field" of 300 V can be formed.

Note that, when the film thickness is changed from 18 μm to 13 μm along with the use of the drum 11, due to the change in potential characteristics of the drum 11, the drum potential during exposure at the laser power L2 changes to −300 V. Therefore, in order to secure the "reverse transfer electric field," as illustrated in FIG. 4B, a control of switching the laser power to laser power L2*n* is performed. That is, in order to maintain the drum surface potential (light section potential) to −200 V, a control of switching the laser power L2 to the laser power L2*n* (L2<L2*n*<L1) of which a laser intensity (exposure amount) is higher is performed. In other words, along with the use of the drum 11, the laser power is increased.

As described above, in accordance with the film thickness change caused by the use of the drum 11, the exposure amount (exposure power) applied during the un-transferred residual toner collecting operation is controlled to stably maintain the "reverse transfer electric field." In other words, along with the use of the drum 11, the drum sensitivity with respect to light reduces. When the same laser power L2 is applied, the absolute value of the drum potential increases. Therefore, along with the use of the drum 11, the laser power is increased from L2 to L2*n*. With this, the "reverse transfer electric field" is stably maintained.

In order to perform this control, before the un-transferred residual toner collecting operation, the control portion 100 reads information mi (μm) relating to an initial film thickness, information mj (μm) relating to an amount of film thickness change, and information ki relating to sensitivity of the drum, which are stored in each of the memories 17Y, 17M, 17C, and 17K. The reading of those pieces of information is performed via the communication portions 101Y, 101M, 101C, and 101K (FIG. 7). Then, the control portion 100 determines the exposure laser power L2 to be applied during formation of the "reverse transfer electric field" in the un-transferred residual toner collecting operation with use of the following expression (Expression 1) set in advance.

$$L2=\{0.56-0.02\times(mi-mj)\}\times ki \quad \text{(Expression 1)}$$

$$mj=\epsilon\times t \quad \text{(Expression 2)}$$

ϵ: coefficient

The information mj (μm) relating to the amount of film thickness change is calculated based on the number of printed sheets "t" (sheets), and is information written from the control portion 100 onto the memory 17 as needed. Further, the coefficient ϵ is a coefficient which is arbitrarily optimized in accordance with the characteristics of the photosensitive member and the image forming apparatus. When a sensor is provided to detect the state of the atmosphere in which the image forming apparatus is used, such as temperature and humidity, correction may be made in accordance with the detected atmosphere state, to thereby enable control in more detail.

Note that, in the embodiment, Expression 1 and Expression 2 are each a linear function, but those expressions are determined as appropriate depending on the characteristics of the photosensitive member, and may be polynomial expressions or expressions of a plurality of curved lines. Further, control is possible also in a case where a table for switching the laser power in a stepwise manner in accordance with the film thickness is provided in advance to the control portion of the image forming apparatus main body.

Further, the amount of film thickness change of the photosensitive layer may be calculated by selecting any one of, in addition to the number of printed sheets, the charging bias application time and drum rotation time, or combining those items. Further, the information ki relating to sensitivity of a new drum 11 may be stored in the memory 17 at the time of manufacture, to thereby correct the laser power L2 based on the potential characteristics of the drum 11. In this manner, the "reverse transfer electric field" can be controlled in more detail.

Further, even when different initial film thicknesses of the plurality of drums 11Y, 11M, 11C, and 11K are set, in this control, a predetermined "reverse transfer electric field" can be formed for each of the plurality of drums. Therefore, a plurality of types of drums having different duration of life can be adopted, and thus the usability may increase.

Further, regarding the distinction between the collecting station and the non-collecting station, for example, a detection device configured to detect the collected toner amount, such as an optical sensor, is provided to the cleaning device 14 of the drum 11 so that, based on the detection results, the un-transferred residual toner is distributed. With this, it is possible to prevent a specific cleaning device 14 from becoming full with the collected toner to eliminate the necessity to replace the process cartridge 10.

Further, a detection device configured to detect the remaining amount of unused toner inside the developing device can be provided to select the collecting station of the un-transferred residual toner based on the detection results. This becomes possible by acquiring in advance a correlation between the collected amount of the un-primarily-transferred residual toner on the drum and the unused toner amount inside the developing device. Further, it is possible to determine the collecting station by calculating the used toner amount based on data on images printed in respective colors or the number of printed sheets, and acquiring a correlation between the used toner amount and the collected toner amount inside the cleaning device in advance.

Note that, in the present invention, as an exposure device configured to expose the drum 11 during the un-transferred residual toner collecting operation, the laser exposure unit 20 configured to scan and expose the drum 11 with light during image formation is used. However, the present invention is applicable also in the case where another exposure device using an LED or the like is provided and controlled.

(1-3) Description of Schematic Configuration Relating to High Voltage Power Source Circuit Connection of the respective bias sources in the embodiment will be described with reference to the wiring diagram of FIG. 7. The charging rollers 12Y, 12M, 12C, and 12K of the respective cartridges 10Y, 10M, 10C, and 10K are connected to the charging bias source 602. A common circuit is formed so that the same charging bias voltage is applied to the charging rollers 12Y, 12M, 12C, and 12K.

Further, similarly, the primary transfer rollers 31Y, 31M, 31C, and 31K are connected to the primary transfer bias source 701. A common circuit is formed so that the same primary transfer bias voltage is applied to the primary transfer rollers 31Y, 31M, 31C, and 31K.

As described above, in the image forming apparatus 1 of the embodiment, a common power source is provided for the charging rollers 12Y, 12M, 12C, and 12K of the respective cartridges 10Y, 10M, 10C, and 10K, and a common power source is provided for the primary transfer rollers 31Y, 31M, 31C, and 31K. With this, the number of power sources can be reduced to realize the reduction in size and cost of the image forming apparatus 1.

Figure 1:
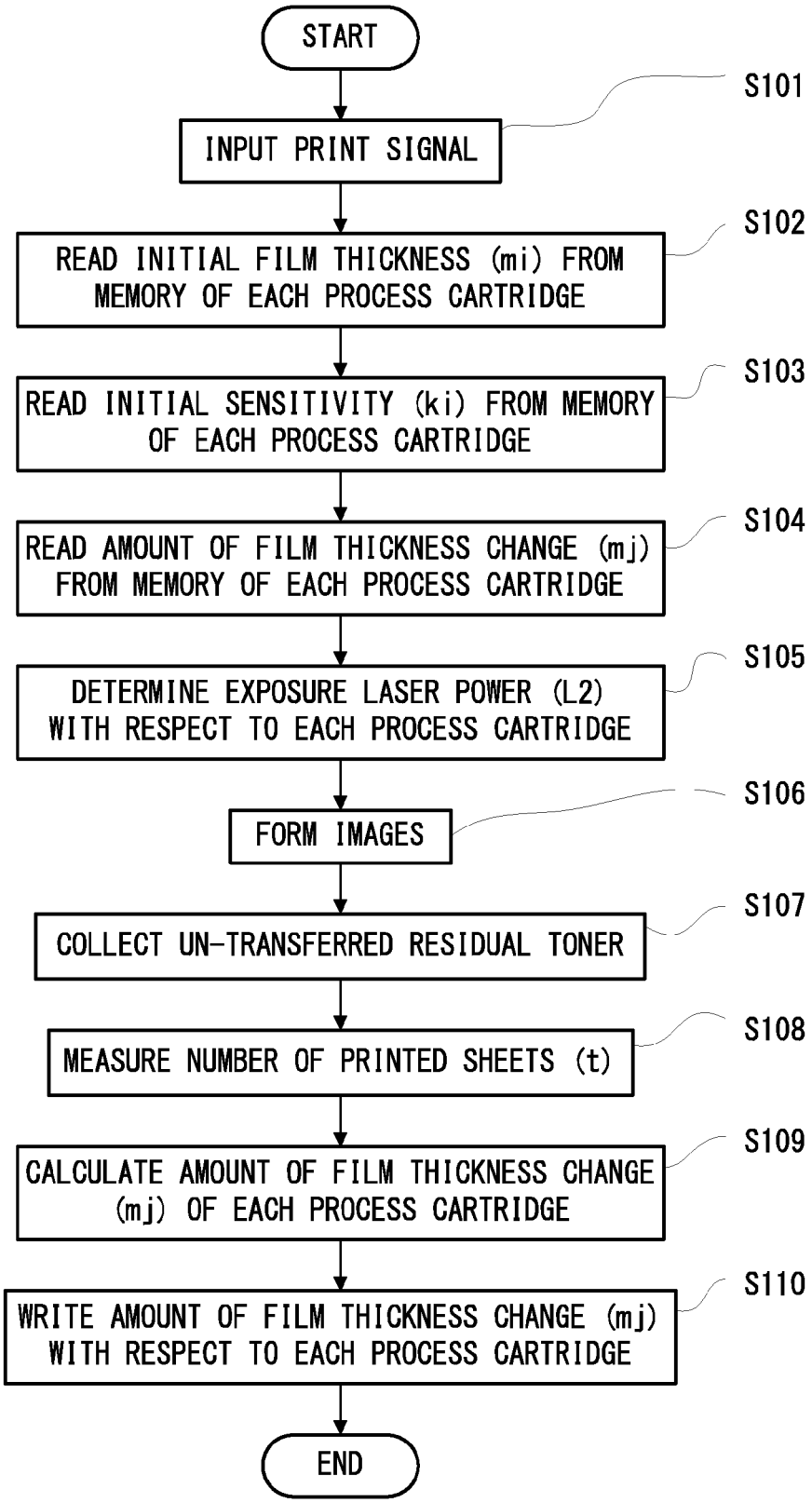
FIG. 1 is a flowchart illustrating laser power control according to a first embodiment.

(1-4) Flowchart Illustrating Control in Un-Transferred Residual Toner Collecting Operation Next, referring to the flowchart of FIG. 1, a method of controlling the exposure laser power in the embodiment will be described. When a print signal is input from the print controller (external host apparatus) 200 (S101), the control portion 100 communicates with the memories 17Y, 17M, 17C, and 17K mounted in the cartridges 10Y, 10M, 10C, and 10K via the communication portions 101, respectively. Then, the control portion 100 reads the stored pieces of information mi relating to the initial film thickness, information ki relating to the initial sensitivity, and information mj relating to the amount of film thickness change of each of the drums 11 (S102 to S104).

Next, the control portion 100 determines, based on the above-mentioned Expression 1, the exposure laser power L2 to be applied with respect to each cartridge in the un-transferred residual toner collecting operation (S105). Then, the image formation operation is performed (S106). Then, the un-transferred residual toner collecting operation is executed (S107), and the number of sheets "t" printed during image formation is measured (S108). The control portion 100 calculates, based on Expression 2, the amount of film thickness change mj based on the measurement results (S109), and then writes (overwrites) the calculation results to the memory 17 of each cartridge via the communication portion 101 (S110).

Actually, in the image forming apparatus which performed charging bias control, a charging bias Vp applied during formation of the reverse transfer electric field in the un-transferred residual toner collecting operation was fixed to −1,000 V, and a primary transfer bias Vt was fixed to −500 V. Then, the print test of 10,000 sheets was performed until the film thickness of the drum 11 reduced from 18 μm to 13 μm. At this time, control was performed with the exposure laser power L1 for the drum 11 of 0.5 $\mu J/cm^2$, the photosensitive member sensitivity coefficient ki of 1, and the coefficient $\epsilon$ of $5\times10^{-4}$.

As a result, as shown in FIG. 4A, the drum surface potential during formation of the reverse transfer electric field when the exposure laser power L2*n* was 0.3 $\mu J/cm^2$ became −200 V. In this manner, without deteriorating the sensitivity of the drum, the un-transferred residual toner collecting operation was satisfactorily performed.

Second Embodiment

The image forming apparatus 1 and the drum 11 according to a second embodiment of the present invention are similar to those of the first embodiment. In the embodiment, in accordance with the film thickness of the drum 11, the primary transfer bias applied during the un-transferred residual toner collecting operation is controlled to stabilize the "reverse transfer electric field."

(2-1) Description Relating to Un-Transferred Residual Toner Collecting Operation In the embodiment, for the purpose of preventing sensitivity deterioration of the drum 11, the exposure amount for the drum 11 is kept low during formation of the "reverse transfer electric field" in the un-transferred residual toner collecting operation. Then, based on the information of the use of the drum 11, the primary transfer bias applied during the un-transferred residual toner collecting operation is controlled.

That is, in order to obtain a predetermined potential difference between the drum 11 and the primary transfer roller 31 based on the information stored in the memory 17, the control portion 100 controls a value of a voltage to be applied to the primary transfer roller (primary transfer unit) 31.

Figure 5:
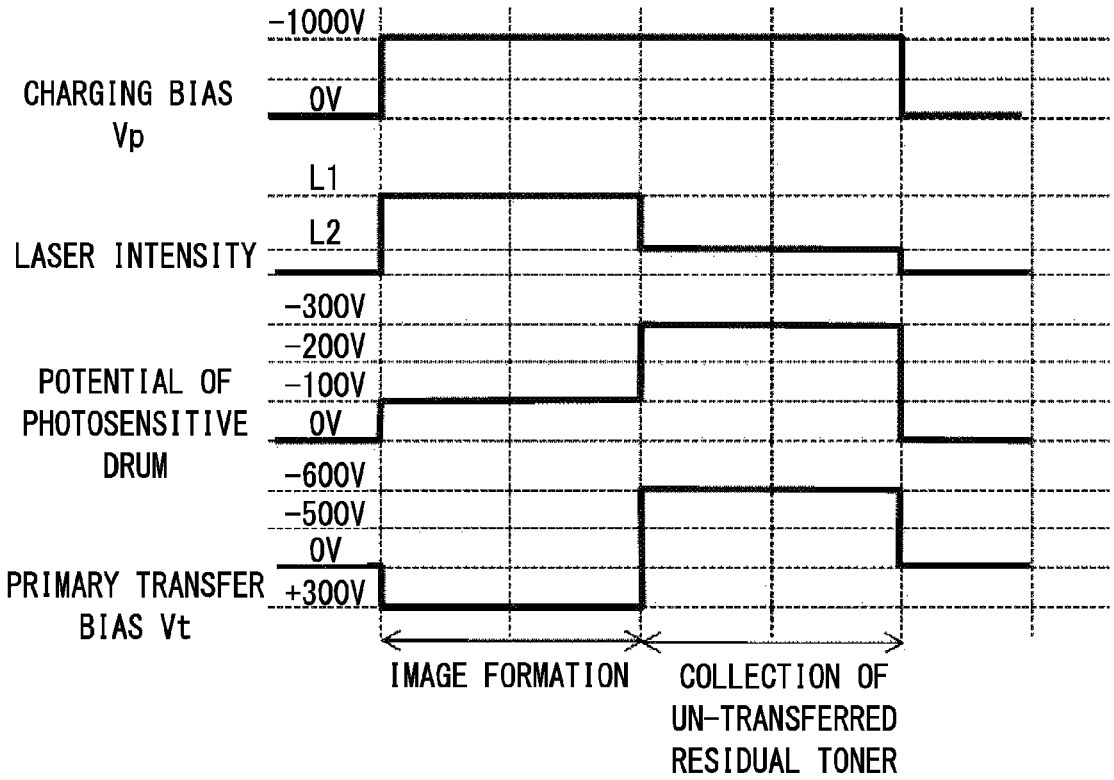
FIG. 5 is a sequence diagram illustrating an un-transferred residual toner collecting operation according to a second embodiment.

Referring to FIGS. 3, 4A, and 5, from the viewpoints of sequence and drum potential characteristics, a specific description will be provided of the control. In the state of the initial film thickness of 18 μm, similarly to the first embodiment, the drum exposure amount is set to the laser power L2 of 0.2 $\mu J/cm^2$ during formation of the "reverse transfer electric field" in the un-transferred residual toner collecting operation, and the drum surface potential is set to −200 V. At this time, by applying the primary transfer bias voltage Vt of −500 V, the "reverse transfer electric field" of 300 V can be formed.

Note that, when the film thickness is changed from 18 μm to 13 μm along with the use of the drum 11, due to the change in potential characteristics of the drum, the drum potential during exposure at the laser power L2 changes to −300 V. Therefore, in order to secure the "reverse transfer electric field," as illustrated in FIG. 5, a control of switching the primary transfer bias Vt from −500 V to −600 V is performed. In other words, along with the use of the drum 11, the absolute value of the primary transfer bias Vt is increased. As described above, in accordance with the film thickness of the drum 11, the primary transfer bias Vt applied during the un-transferred residual toner collecting operation is controlled, to thereby stably maintain the "reverse transfer electric field."

In order to perform this control, in the un-transferred residual toner collecting operation, the control portion 100 reads the information mi (μm) relating to the initial film thickness, the information mj (μm) relating to the amount of film thickness change, and the information ki relating to the sensitivity of the drum 11, which are stored in each of the memories 17Y, 17M, 17C, and 17K. Then, the control portion 100 determines the primary transfer bias Vt to be applied during formation of the reverse transfer electric field in the un-transferred residual toner collecting operation with use of the following expression (Expression 3) set in advance.

$$Vt=\{860-20\times(mi-mj)\}\times ki \quad \text{(Expression 3)}$$

Note that, similarly to the first embodiment, the information mj (μm) relating to the amount of film thickness change is calculated based on the number of printed sheets "t" (sheets) as in Expression 2, and is information written onto the memory 17 as needed.

Further, in the embodiment, it is unnecessary to switch the exposure amount L2 to be applied during formation of the "reverse transfer electric field," and hence even when a longer operating life is given to the photosensitive drum, the occurrence of sensitivity deterioration is more effectively prevented.

(2-2) Description of Schematic Configuration Relating to High Voltage Power Source Circuit Connection of the respective bias sources in the embodiment will be described with reference to the wiring diagram of FIG. 7. The charging rollers 12Y, 12M, 12C, and 12K of the respective cartridges 10Y, 10M, 10C, and 10K illustrated in FIG. 7 are connected to the charging bias source 602. Further, a common circuit is formed so that the charging bias source 602 applies the same charging bias voltage to the charging rollers 12Y, 12M, 12C, and 12K.

On the other hand, the primary transfer rollers 31Y, 31M, 31C, and 31K are connected to primary transfer bias sources 701, and different primary transfer bias voltages can be individually applied to the primary transfer rollers 31Y, 31M, 31C, and 31K.

As described above, in the image forming apparatus 1 of the embodiment, a common power source is provided for the charging rollers 12Y, 12M, 12C, and 12K of the respective cartridges 10Y, 10M, 10C, and 10K, and hence the number of power sources is reduced. With this, it is possible to realize the reduction in size and cost of the image forming apparatus 1.

Figure 8:
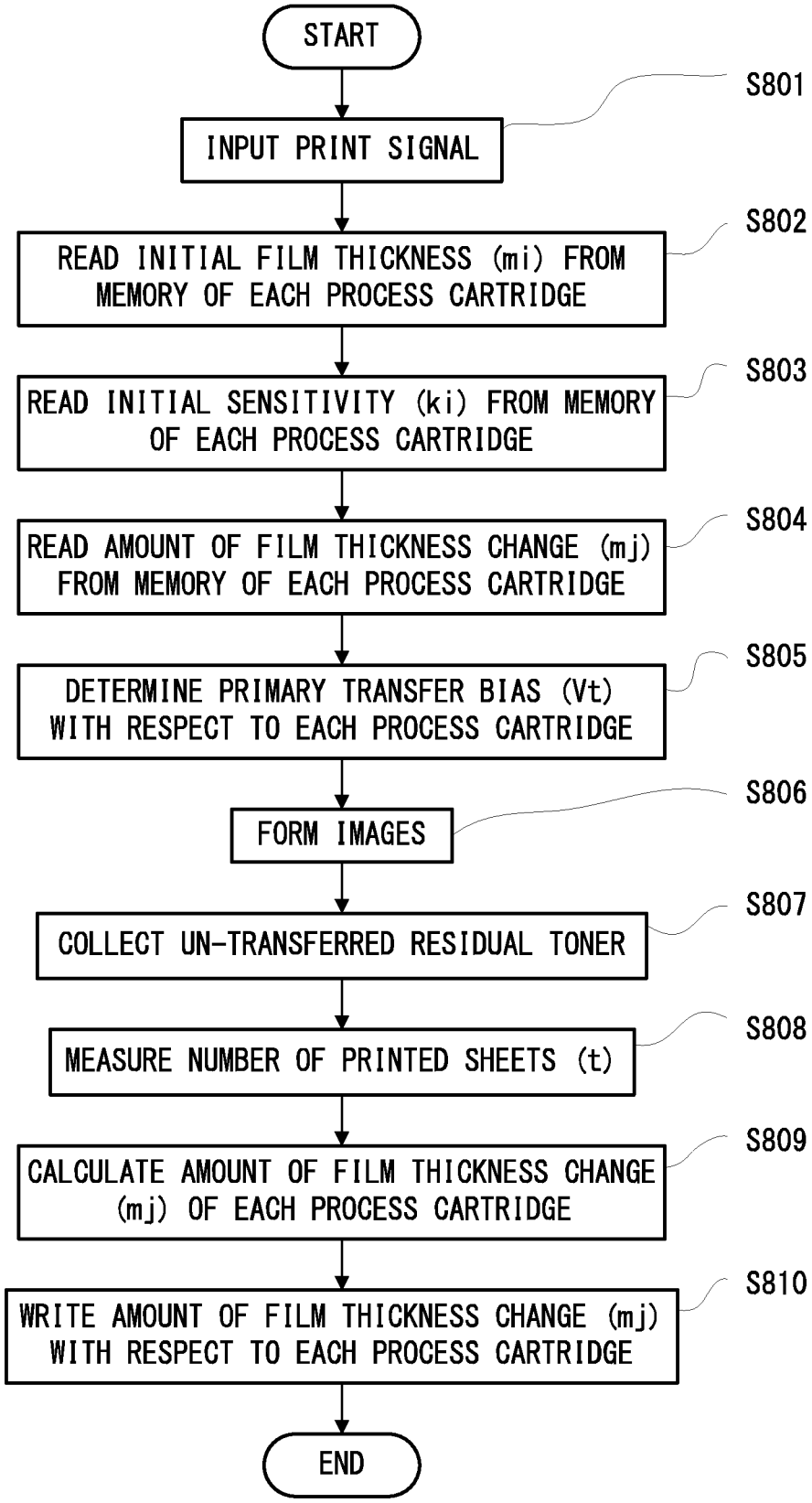
FIG. 8 is a flowchart illustrating a primary transfer bias control according to the second embodiment.

(2-3) Flowchart Illustrating Control in Un-Transferred Residual Toner Collecting Operation Next, referring to the flowchart of FIG. 8, a method of controlling the primary transfer bias in the embodiment will be described. When a print signal is input from the print controller (external host apparatus) 200 (S801), the control portion 100 communicates with the memories 17Y, 17M, 17C, and 17K mounted in the cartridges 10Y, 10M, 10C, and 10K via the communication portions 101, respectively. Then, the control portion 100 reads the stored pieces of information mi relating to the initial film thickness, information ki of the initial sensitivity, and information mj of the amount of film thickness change of each of the drums 11 (S802 to S804).

Next, the control portion 100 determines, based on the above-mentioned Expression 3, the output value of the primary transfer bias Vt to be applied with respect to each cartridge in the un-transferred residual toner collecting operation (S805). Then, the image formation operation is performed (S806). Then, the un-transferred residual toner collecting operation is executed (S807), and the number of sheets "t" printed during image formation is measured (S808).

The control portion 100 calculates, based on the above-mentioned Expression 2, the amount of film thickness change mj based on the measurement results (S809), and then writes (overwrites) the calculation results to the memory of each cartridge via the communication portion 101 (S810).

Actually, in the image forming apparatus which performed charging bias control, the charging bias Vp applied during formation of the reverse transfer electric field in the un-transferred residual toner collecting operation was fixed to −1,000 V, and the exposure laser power L2 for the drum 11 was fixed to 0.2 μJ/cm$^2$. Then, the print test of 10,000 sheets was performed until the film thickness of the drum 11 reduced from 18 μm to 13 μm. At this time, control was performed with the exposure laser power L1 for the drum 11 of 0.5 μJ/cm$^2$, the photosensitive member sensitivity coefficient ki of 1, and the coefficient $\epsilon$ of $5\times10^{-4}$.

As a result, as illustrated in FIG. 5, the drum surface potential when the film thickness was 13 μm and the exposure laser power L2 was 0.2 μJ/cm$^2$ became −300 V, and the primary transfer bias Vt became −600 V. In this manner, without deteriorating the sensitivity of the drum, the un-transferred residual toner collecting operation was satisfactorily performed.

Third Embodiment

The image forming apparatus 1 and the drum 11 according to a third embodiment are similar to those of the first embodiment. In the embodiment, in accordance with the film thickness of the drum 11, the charging bias applied during the un-transferred residual toner collecting operation is controlled to stabilize the "reverse transfer electric field."

(3-1) Description Relating to Un-Transferred Residual Toner Collecting Operation In the embodiment, for the purpose of preventing sensitivity deterioration of the drum 11, the exposure amount for the drum 11 is kept low during formation of the "reverse transfer electric field" in the un-transferred residual toner collecting operation. Then, based on the information of the use of the drum 11, the charging bias applied during the un-transferred residual toner collecting operation is controlled.

That is, in order to obtain a predetermined potential difference between the drum 11 and the primary transfer roller 31 based on the information stored in the memory 17, the control portion 100 controls a value of a voltage to be applied to the charging roller (charging device) 12.

Referring to FIGS. 3, 4A, 6A, and 6B, from the viewpoints of sequence and drum potential characteristics, a specific description will be provided of the control. As illustrated in FIG. 3, in the state of the initial film thickness of 18 μm, similarly to the first embodiment, the drum exposure amount is set to the laser power L2 of 0.2 μJ/cm$^2$ during formation of the "reverse transfer electric field" in the un-transferred residual toner collecting operation, and the drum surface potential is set to −200 V. At this time, by applying the primary transfer bias of −500 V, the "reverse transfer electric field" of 300 V can be formed.

Figure 6A:
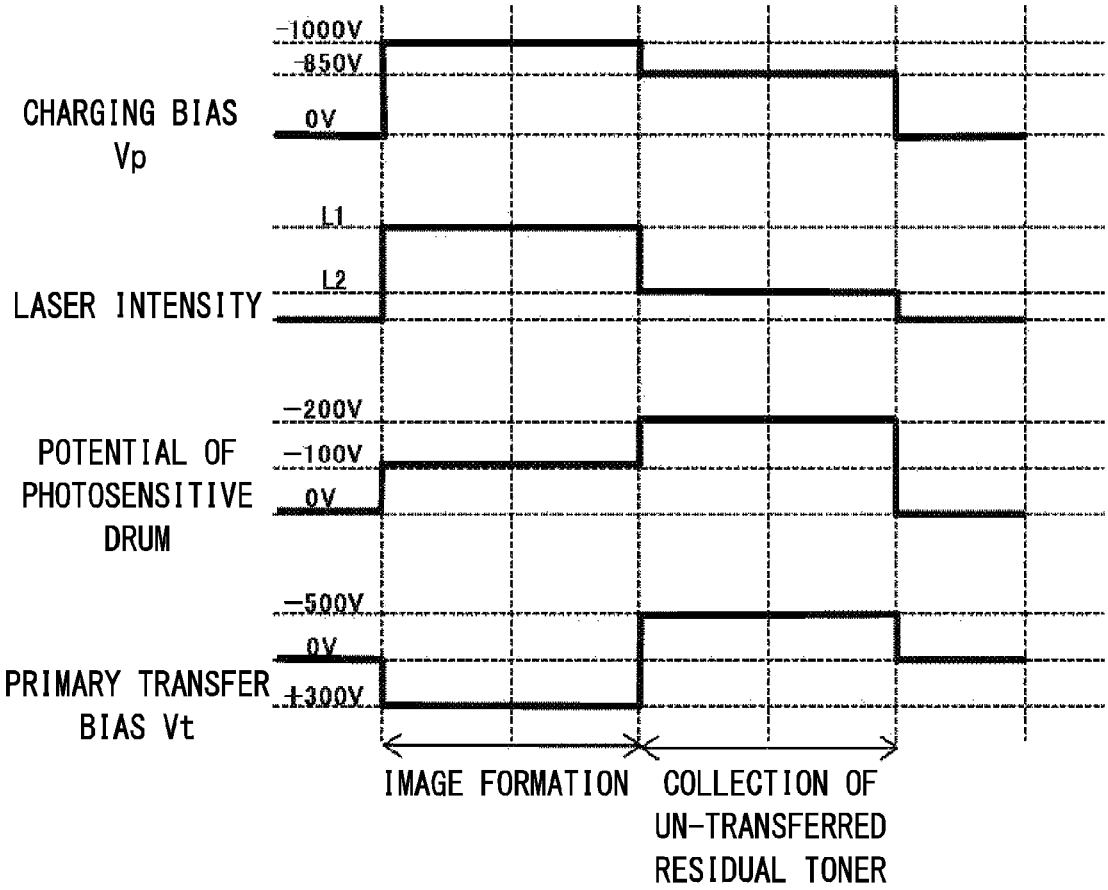
FIG. 6A is a sequence diagram illustrating an un-transferred residual toner collecting operation according to a third embodiment.
Figure 6B:
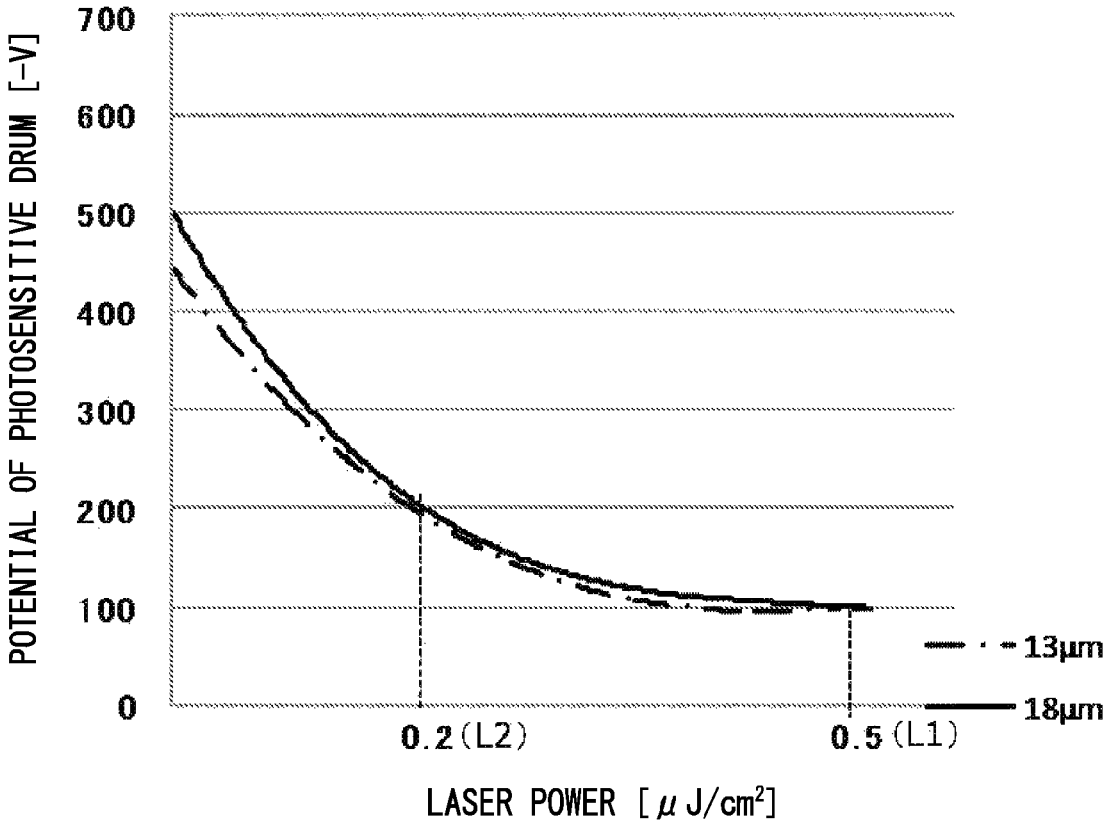
FIG. 6B is a graph showing sensitivity characteristics of a photosensitive drum according to the third embodiment.

Note that, when the film thickness is changed from 18 μm to 13 μm along with the use of the drum 11, as shown in FIG. 4A, due to the change in potential characteristics of the drum 11, the drum potential during exposure with the laser power L2 of 0.2 μJ/cm$^2$ changes to −300V. Therefore, in order to secure the "reverse transfer electric field," as illustrated in FIG. 6A, a control of switching the charging bias from −1,000 V to −850 V is performed. In other words, along with the use of the drum 11, the absolute value of the charging bias is reduced. As a result, as shown in FIG. 6B, the drum potential at the time of exposure with the laser power L2 of 0.2 μJ/cm$^2$ can be maintained to −200 V. Thus, the "reverse transfer electric field" can be stably maintained.

In order to perform this control, prior to the un-transferred residual toner collecting operation, the control portion 100 reads the information mi (μm) relating to the initial film thickness, the information mj (μm) relating to the amount of film thickness change, and the information ki relating to the sensitivity of the drum, which are stored in each of the memories 17Y, 17M, 17C, and 17K. Then, the control portion 100 determines the charging bias Vp to be applied during formation of the reverse transfer electric field in the un-transferred residual toner collecting operation with use of the following expression (Expression 4) set in advance.

$$Vp=\{-460-30\times(mi-mj)\}\times ki \quad \text{(Expression 4)}$$

Note that, similarly to the first embodiment, the information mj (μm) relating to the amount of film thickness change is calculated based on the number of printed sheets "t" (sheets) as in Expression 2, and is information written onto the memory 17 as needed.

Further, also in the embodiment, similarly to the second embodiment, it is unnecessary to switch the exposure amount L2 to be applied during formation of the "reverse transfer electric field," and hence even when a longer operating life is given to the photosensitive drum, the occurrence of sensitivity deterioration is more effectively prevented. Further, it is unnecessary to increase the primary transfer bias to be applied during formation of the "reverse transfer electric field" from −500 V, and hence reduction in size and cost of the power source can be realized.

(3-2) Description of Schematic Configuration Relating to High Voltage Power Source Circuit Connection of the respective bias sources in the embodiment will be described with reference to the wiring diagram of FIG. 7. The charging rollers 12Y, 12M, 12C, and 12K of the respective cartridges 10Y, 10M, 10C, and 10K illustrated in FIG. 7 are connected to the charging bias source 602. The charging bias source 602 is configured to apply individually different charging bias voltages to the charging rollers 12Y, 12M, 12C, and 12K.

On the other hand, the primary transfer rollers 31Y, 31M, 31C, and 31K are connected to primary transfer bias sources 701, and primary transfer bias voltages having the same output can be applied to the primary transfer rollers 31Y, 31M, 31C, and 31K.

As described above, in the image forming apparatus 1 of the embodiment, a common power source is provided for the primary transfer rollers 31Y, 31M, 31C, and 31K. With this, the number of power sources can be reduced to realize the reduction in size and cost of the image forming apparatus 1.

Figure 9:
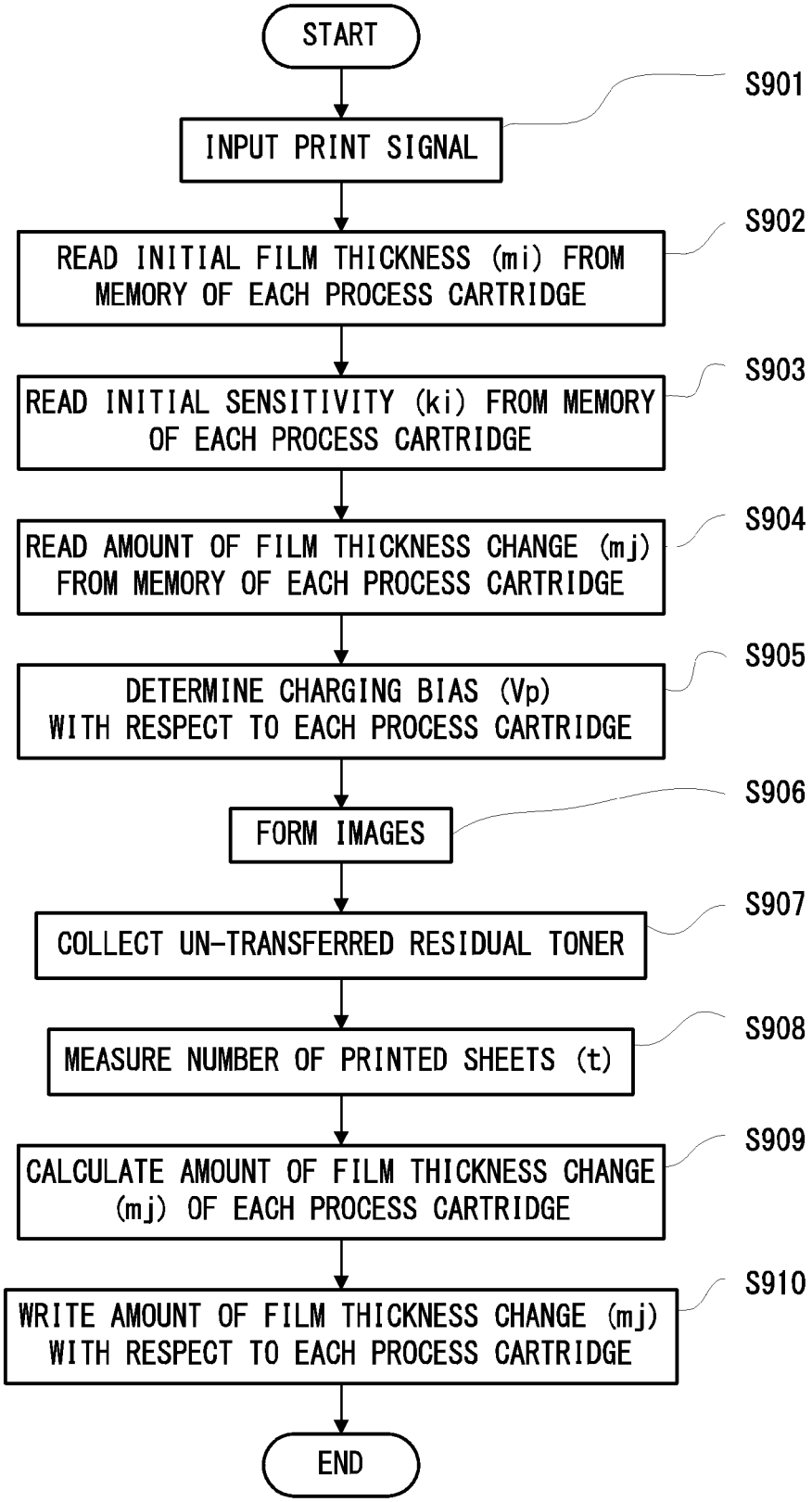
FIG. 9 is a flowchart illustrating a charging bias control according to the third embodiment.

(3-3) Flowchart Illustrating Control in Un-Transferred Residual Toner Collecting Operation Next, referring to the flowchart of FIG. 9, a method of controlling the charging bias in the embodiment will be described. When a print signal is input from the print controller (external host apparatus) 200 (S901), the control portion 100 communicates with the memories 17Y, 17M, 17C, and 17K mounted in the cartridges 10Y, 10M, 10C, and 10K via the communication portions 101, respectively. Then, the control portion 100 reads the pieces of information mi relating to the initial film thickness, information ki relating to the initial sensitivity, and information mj relating to the amount of film thickness change of each of the drums 11, which are stored in each of the memories 17 (S902 to S904).

Next, the control portion 100 determines, based on the above-mentioned Expression 4, the output value of the charging bias Vp with respect to each cartridge in the un-transferred residual toner collecting operation (S905). Then, the image formation operation is performed (S906). Then, the un-transferred residual toner collecting operation is executed (S907), and the number of sheets "t" printed during image formation is measured (S908).

The control portion 100 calculates, based on the above-mentioned Expression 2, the amount of film thickness change mj based on the measurement results (S909), and then writes (overwrites) the calculation results to the memory of each cartridge via the communication portion 101 (S910).

Actually, in the image forming apparatus which performed charging bias control, the primary transfer bias Vt applied during formation of the reverse transfer electric field in the un-transferred residual toner collecting operation was fixed to −500 V, and the exposure laser power L2 for the drum was fixed to 0.2 μJ/cm$^2$. Then, the print test of 10,000 sheets was performed until the film thickness of the drum 11 reduced from 18 μm to 13 μm. At this time, control was performed with the exposure laser power L1 for the drum 11 of 0.5 μJ/cm$^2$, the photosensitive member sensitivity coefficient ki of 1, and the coefficient $\epsilon$ of $5\times10^{-4}$.

As a result, as shown in FIG. 6B, the drum surface potential when the film thickness was 13 μm and the exposure laser power L2 was 0.2 μJ/cm$^2$ became −200 V. In this manner, without deteriorating the sensitivity of the drum, the un-transferred residual toner collecting operation was satisfactorily performed.

Fourth Embodiment

The image forming apparatus 1 and the drum 11 according to a fourth embodiment of the present invention are similar to those of the first embodiment. In the embodiment, in accordance with information relating to the film thickness of the drum 11 and information relating to the exposure history (exposure history information), the exposure laser pattern to be obtained during the un-transferred residual toner collecting operation is controlled to stabilize the "reverse transfer electric field."

(4-1) Description Relating to Un-Transferred Residual Toner Collecting Operation In the embodiment, even when the sensitivity changes due to the long-term use of the drum 11, the "reverse transfer electric field" is stably maintained during the un-transferred residual toner collecting operation. Therefore, based on, in addition to the information on the film thickness of the drum 11, the exposure history information stored in the memory 17, the exposure amount is controlled. Further, as the control of the exposure amount, in contrast to the fixed laser power, the exposure pattern is controlled, to thereby control the drum surface potential.

That is, in order to obtain a predetermined potential difference between the drum 11 and the primary transfer roller 31 based on the information stored in the memory 17, the control portion 100 controls an exposure pattern of the laser exposure unit (exposure device) 20.

Figure 10:
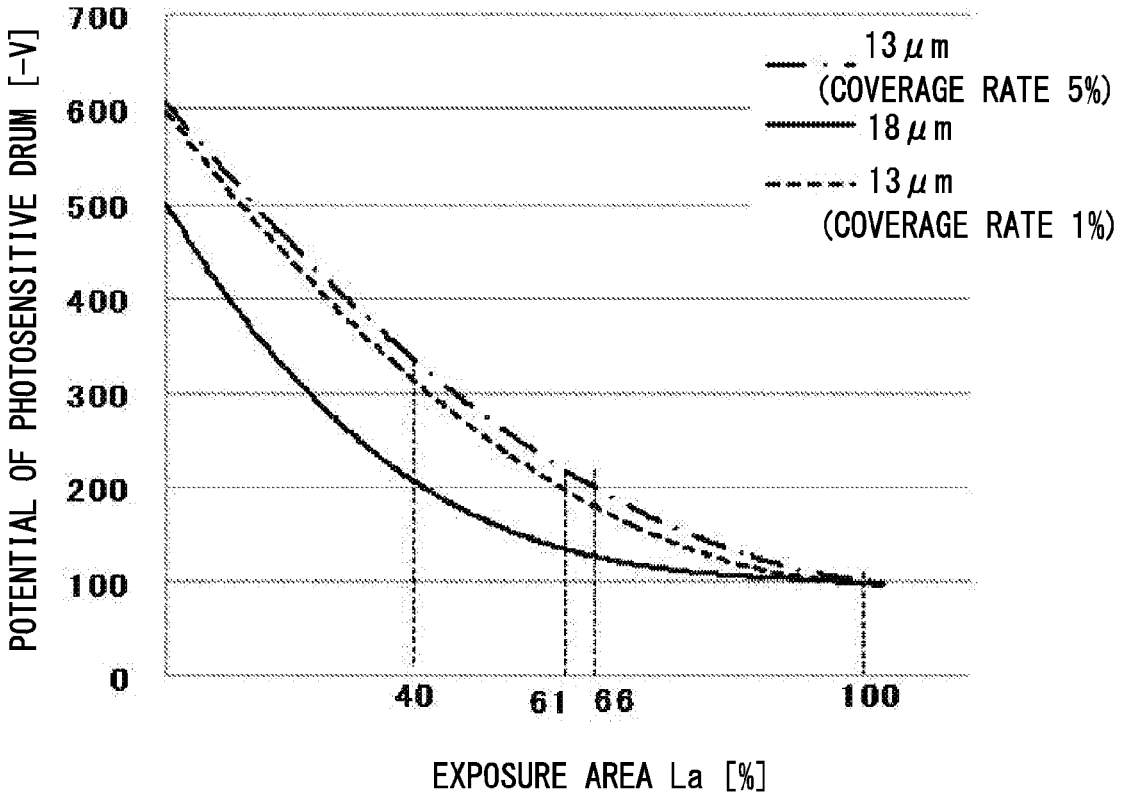
FIG. 10 is a graph showing sensitivity characteristics of a photosensitive drum according to a fourth embodiment.

Referring to FIGS. 4B, 10, and 12A, from the viewpoints of sequence and photosensitive drum potential characteristics, a specific description will be provided of the control. In the state of the initial film thickness of 18 μm, similarly to the conventional example, as illustrated in FIG. 12A, the drum exposure amount to be applied during formation of the "reverse transfer electric field" in the un-transferred residual toner collecting operation is set to the laser power L1. At this time, the entire region is not exposed with light, and, for example, exposure is performed in an area ratio (exposure area La) of 40%, to thereby control the drum surface potential to −200 V as shown in FIG. 10. At this time, by applying the primary transfer bias of −500 V (FIG. 4B), the "reverse transfer electric field" of 300 V can be formed.

In this case, when the film thickness changes from 18 μm to 13 μm through use of the drum 11, as shown in FIG. 10, depending on the coverage rate history, the charging characteristics of the drum 11 change. This corresponds to a change in sensitivity of the drum 11, which occurs when the image formation is repeated at the laser power L1 (FIG. 12A). Therefore, a correlation between the exposure history and the sensitivity change is acquired in advance, and based on the exposure history, the image pattern is corrected, to thereby enable control of the drum surface potential in detail.

Specifically, the number of pixels on which an image is formed at the laser power L1 is measured, and information (exposure history information) kp relating to the exposure history calculated based on the cumulative pixel count value is stored in the memory 17.

Further, prior to the un-transferred residual toner collecting operation, the control portion 100 reads the information mi (μm) relating to the initial film thickness of the drum 11 and the information mj (μm) relating to the amount of film thickness change, which are stored in each of the memories 17Y, 17M, 17C, and 17K. Further, the control portion 100 reads the information ki relating to the sensitivity of the drum 11 and the exposure history information kp. Then, the control portion 100 determines the exposure area La (%) during formation of the reverse transfer electric field in the un-transferred residual toner collecting operation with use of the following expression (Expression 5) set in advance.

$$La=\{112-4\times(mi-mj)\}\times ki\times kp \quad \text{(Expression 5)}$$

$$kp=1+\alpha\times p \quad \text{(Expression 6)}$$

α: coefficient

Note that, similarly to the first embodiment, the information mj (μm) relating to the amount of film thickness change is calculated based on the number of printed sheets "t" (sheets) as in the above-mentioned Expression 2, and is information written onto the memory 17 as needed.

Further, the information kp relating to the exposure history is calculated as the above-mentioned Expression 6 based on the number of pixels p measured from the image data for the image formation. In this case, the coefficient α is a coefficient determined based on the characteristics of the image forming apparatus 1 and the drum 11, and the number of pixels p can employ a cumulative value of the average coverage rate (%) for each printing.

Further, also in the embodiment, similarly to the first embodiment, it is unnecessary to switch the charging bias and the primary transfer bias to be applied during formation of the "reverse transfer electric field," and hence a common charging bias source and a common primary transfer bias source can be provided. Thus, cost reduction can be realized. Further, in addition to the number of pixels p exposed in the image formation, the history of exposure for the formation of the reverse transfer electric field in the un-transferred residual toner collecting operation is considered for control, and thus the control can be performed in more detail.

Figure 11:
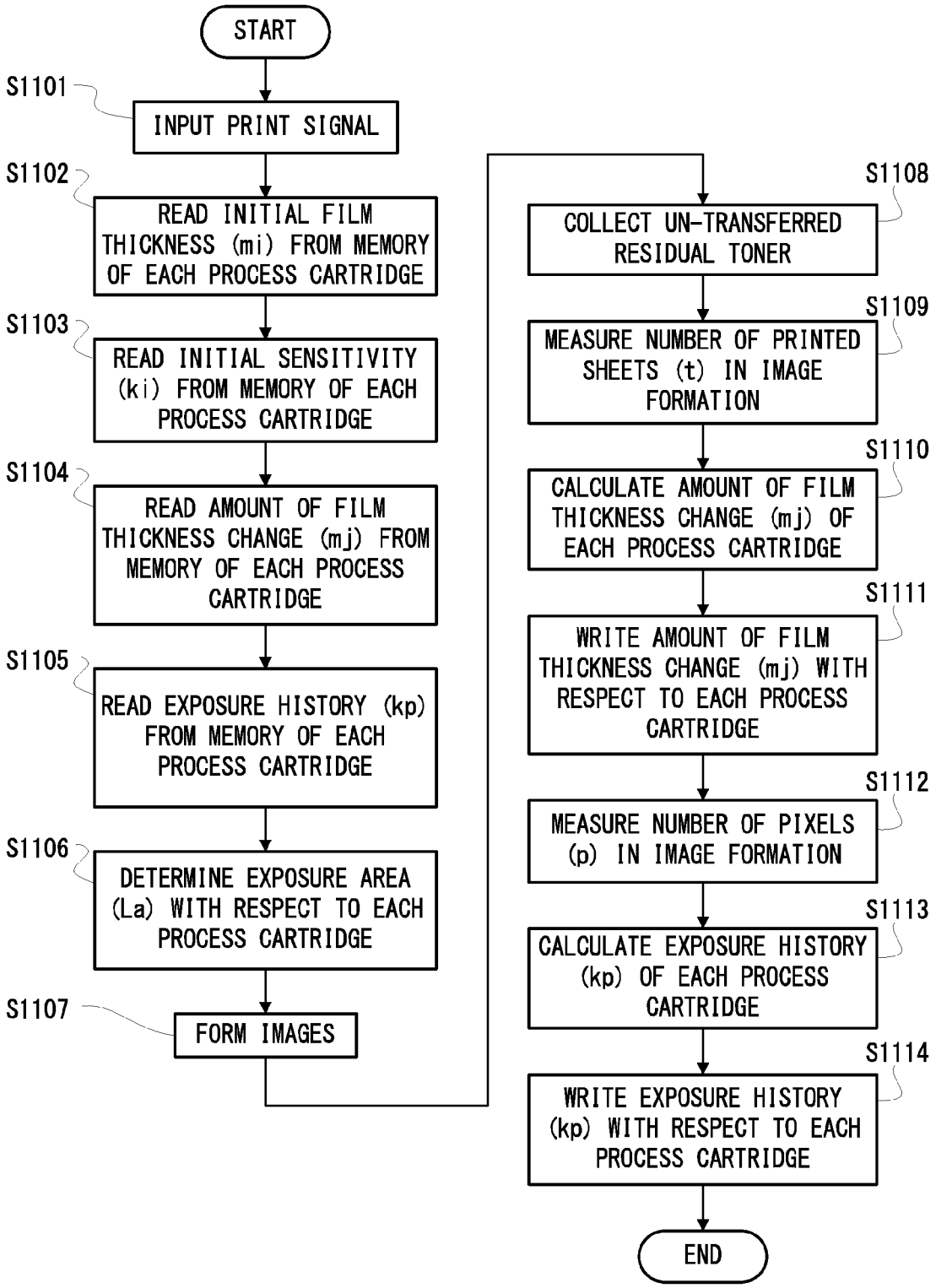
FIG. 11 is a flowchart illustrating a charging bias control according to the fourth embodiment.

(4-2) Flowchart Illustrating Control in Un-Transferred Residual Toner Collecting Operation Next, referring to the flowchart of FIG. 11, a method of controlling the exposure pattern in the embodiment will be described. When a print signal is input from the print controller (external host apparatus) 200 (S1101), the control portion 100 communicates with the memories 17Y, 17M, 17C, and 17K mounted in the cartridges 10Y, 10M, 10C, and 10K via the communication portions 101, respectively. Then, the control portion 100 reads the pieces of information mi relating to the initial film thickness, information ki relating to the initial sensitivity, information mj relating to the amount of film thickness change, and information kp relating to the exposure history of each of the drums 11, which are stored in each of the memories 17 (S1102 to S1105).

Next, the control portion 100 determines, based on the above-mentioned Expression 5, the exposure area La with respect to each cartridge in the un-transferred residual toner collecting operation (S1106). Then, the image formation operation is performed (S1107). Then, the un-transferred residual toner collecting operation is executed (S1108), and the number of sheets "t" printed during image formation is measured (S1109).

The control portion 100 calculates, based on the above-mentioned Expression 2, the amount of film thickness change mj based on the measurement results (S1110), and then writes (overwrites) the calculation results to the memory 17 of each cartridge via the communication portion 101 (S1111). Further, the control portion 100 measures the number of pixels p exposed in image formation (S1112). Then, based on the above-mentioned Expression 6, the control portion 100 calculates the exposure history kp (S1113), and writes (overwrites) the calculation results onto the memory 17 of each cartridge via the communication portion 101 (S1114).

Actually, in the image forming apparatus which performed exposure pattern control, the charging bias Vp applied during formation of the reverse transfer electric field in the un-transferred residual toner collecting operation was fixed to −1,000 V, and the primary transfer bias Vt was fixed to −500 V. Further, the exposure laser power L2 for the drum was fixed to 0.5 μJ/cm$^2$. Then, the print test of 10,000 sheets was performed at coverage rates of 1% and 5% until the film thickness of the photosensitive member reduced from 18 μm to 13 μm. At this time, control was performed with the photosensitive member sensitivity coefficient ki of 1, the coefficient ϵ of $5\times10^{-4}$, and the coefficient α of $2\times10^{-6}$.

The results are shown in FIG. 10. The exposure area La was controlled to 61% and 66% when the film thickness was 13 μm. Thus, the drum surface potential became −200 V in any case. In this manner, without sensitivity deterioration of the drum 11, the un-transferred residual toner collecting operation was satisfactorily performed.

In this case, the image forming apparatus may be configured to perform the above-mentioned controls of the first to fourth embodiments in combination as appropriate. That is, the image forming apparatus may be configured so that the control portion 100 performs the following control when the un-transferred residual toner collecting operation is executed. In order to obtain a predetermined potential difference between the drum 11 and the primary transfer roller 31, based on the information stored in the memory 17, at least one of the charging roller 12, the primary transfer roller 31, and the exposure unit 20 is controlled.

The memory 17 stores at least the information relating to the film thickness of the drum, the information relating to the sensitivity, and the information relating to the exposure history. The image forming apparatus may be configured so that the control portion 100 performs the control based on at least one of the above-mentioned pieces of information stored in the memory 17.

The image forming apparatus may be configured so that the control portion 100 controls a value of a voltage to be applied to the charging roller 12 based on the information stored in the memory 17 in order to obtain the predetermined potential difference between the drum 11 and the primary transfer roller 31.

The image forming apparatus may be configured so that the control portion 100 controls a value of a voltage to be applied to the primary transfer roller 31 based on the information stored in the memory 17 in order to obtain the predetermined potential difference between the drum 11 and the primary transfer roller 31.

The image forming apparatus may be configured so that the control portion 100 controls at least one of the exposure pattern and exposure power of the exposure unit 20 based on the information stored in the memory 17 in order to obtain the predetermined potential difference between the drum 11 and the primary transfer roller 31.

Fifth Embodiment

Figure 13:
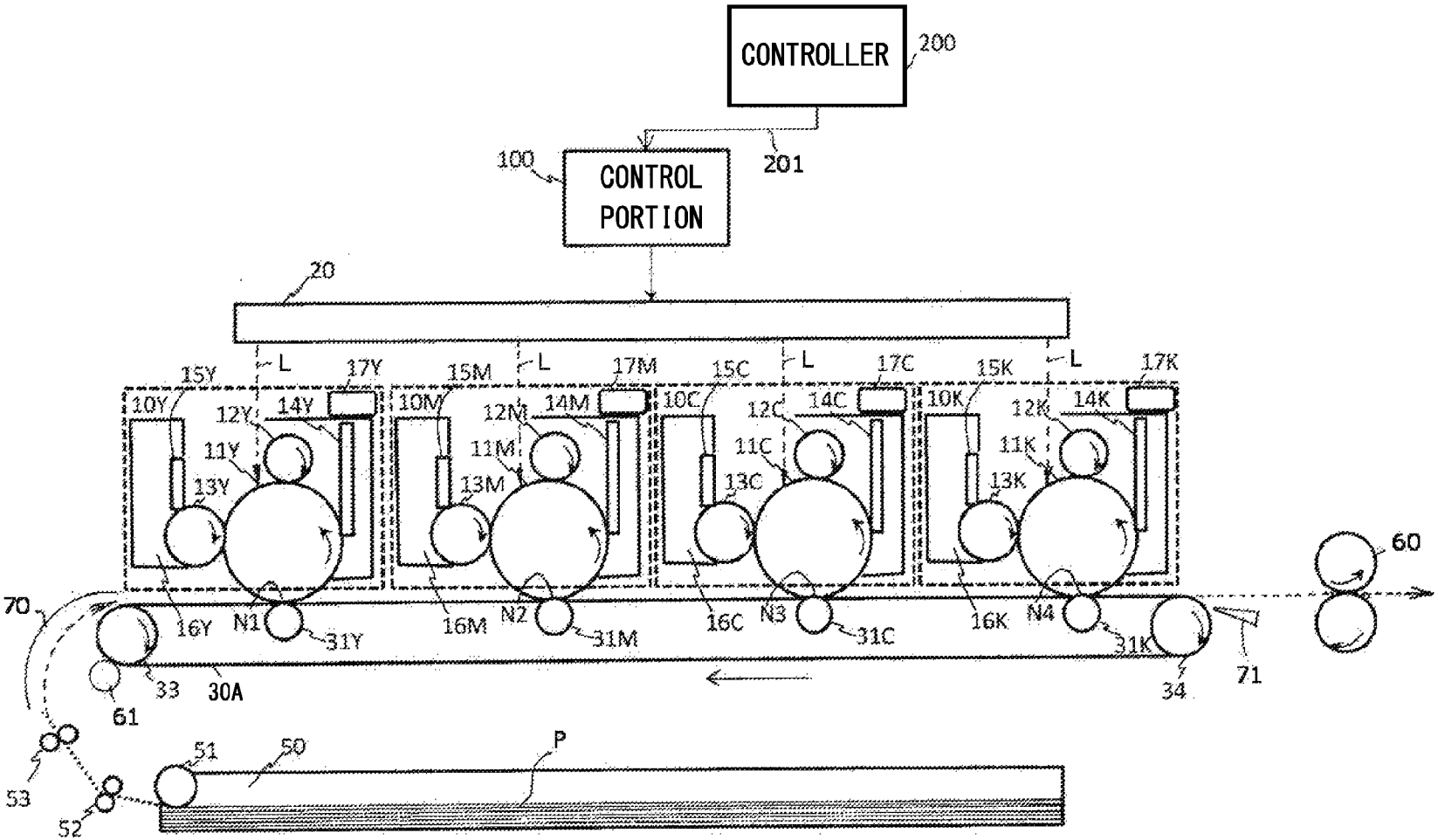
FIG. 13 is a schematic configuration view of an image forming apparatus according to a fifth embodiment.

FIG. 13 is a schematic configuration view of a main part of an image forming apparatus according to a fifth embodiment of the present invention. In this apparatus, the intermediate transfer in-line type electrophotographic laser beam printer of the first embodiment is replaced with a direct transfer in-line type apparatus which uses a recording material conveying member. The constituent members and parts in common with those of the first embodiment are denoted by the same reference symbols, and overlapping description thereof is omitted.

The configurations of the four image forming units (process cartridges) 10Y, 10M, 10C, and 10K are the same as those in the apparatus of the first embodiment. In the apparatus of the embodiment, the intermediate transfer belt 30 in the apparatus of the first embodiment is replaced with a transfer belt 30A serving as a recording material conveying member which is configured to circulate while carrying the sheet (recording material) P.

A single sheet P is separated and fed from the sheet cassette 50 by the drive of the pick-up roller 51, and is guided by a guide 70 via the conveying roller 52 and the registration roller 53 to be fed from the roller 33 to an ascending side of the transfer belt 30A at a predetermined control timing. Then, the sheet P is carried by the transfer belt 30A to be conveyed toward the roller 34.

With this conveyance, the sheet P sequentially passes through the transfer portions N1, N2, N3, and N4 of the respective cartridges 10Y, 10M, 10C, and 10K to be sequentially subjected to transfer of toner images of the respective colors of Y, M, C, and K. In this manner, on the sheet P, a full-color unfixed toner image of four colors of Y, M, C, and K is formed is a superimposed manner by the direct transfer in-line system. Then, the sheet P is separated from the transfer belt 30A at a recording material separating position 71 at the roller 34 to be introduced to the fixing device 60.

The recording material separating position 71 is a position at which a leading edge portion of the sheet P that has been carried and conveyed by the transfer belt 30A and passed through the transfer portion N4 of the cartridge 10K arranged on the most downstream side of the transfer belt 30A in the moving direction thereof is separated from the transfer belt 30A. The sheet P is separated from the surface of the transfer belt 30A by a separating unit or due to a self stripping. The brush roller 61 is arranged in contact with the transfer belt 30A at a belt wrapping portion of the roller 33.

Also in such a direct transfer in-line type apparatus, it is possible to execute the remaining toner collecting operation of transferring the toner remaining and adhering to the transfer belt 30A onto the photosensitive drum 11 of the cartridge 10 to collect the toner by the cleaning device 14.

Then, when the remaining toner collecting operation is executed, the control of the un-transferred residual toner collecting operation similar to those in the first to fourth embodiments is applied. With this, it is possible to prevent sensitivity deterioration over a long-term use of the drum 11, and satisfactorily collect the toner remaining and adhering to the transfer belt 30A without occurrence of reduction in image density.

That is, similarly to the first to fourth embodiments, in order to obtain a predetermined potential difference between the drum 11 and the primary transfer roller 31, based on the information stored in the memory 17, at least one of the charging roller 12, the primary transfer roller 31, and the exposure unit 20 is controlled.

The memory 17 stores at least the information relating to the film thickness of the drum 11, the information relating to the sensitivity, and the information relating to the exposure history. The image forming apparatus may be configured so that the control portion 100 performs the control based on at least one of the above-mentioned pieces of information stored in the memory 17.

The image forming apparatus may be configured so that the control portion 100 controls a value of a voltage to be applied to the charging roller 12 based on the information stored in the memory 17 in order to obtain the predetermined potential difference between the drum 11 and the primary transfer roller 31.

The image forming apparatus may be configured so that the control portion 100 controls a value of a voltage to be applied to the primary transfer roller 31 based on the information stored in the memory 17 in order to obtain the predetermined potential difference between the drum 11 and the primary transfer roller 31.

The image forming apparatus may be configured so that the control portion 100 controls at least one of the exposure pattern and exposure power of the exposure unit 20 based on the information stored in the memory 17 in order to obtain the predetermined potential difference between the drum 11 and the primary transfer roller 31.

According to the embodiments of the present invention, it is possible to provide the image forming apparatus which is configured to prevent sensitivity deterioration over a long-term use of the image bearing member, and satisfactorily collect the toner remaining on the intermediate transfer member without occurrence of reduction in image density.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-094686, filed Apr. 18, 2012, which is hereby incorporated by reference herein in its entirety.

What is claimed is:

1. An image forming apparatus configured to form an image on a recording material, the image forming apparatus comprising:

first and second image forming stations, each including:

(1) an image bearing member;

(2) a charging device configured to charge the image bearing member;

(3) a transfer device configured to transfer a developer image from the image bearing member; and (4) a cleaning device configured to remove developer adhering to the image bearing member;

an exposure device configured to expose each of the image bearing members with light to form a latent image on each of the image bearing members;

a circulating member which is configured to pass between the image bearing members and the respective transfer devices and circulate in the image forming apparatus;

a storage portion configured to store information relating to a usage amount of the image bearing member of the second image forming station, the information including at least one of information relating to a film thickness of the image bearing member, information relating to sensitivity of the image bearing member, and information relating to an exposure history of the image bearing member; and a control portion configured to execute a developer collecting operation of moving the developer adhering to the circulating member to one of the first and the second image bearing members for collection of the developer by the corresponding cleaning device, wherein, when executing the developer collecting operation, the control portion is configured to form an electric field having a same direction as a direction in image formation between the image bearing member and the transfer device of the first image forming station, and form a reverse electric field having an opposite direction to the direction in image formation between the image bearing member exposed by the exposure device and the transfer device of the second image forming station, wherein the control portion controls, when forming the reverse electric field in the second image forming station, an amount of exposure of the exposure device for exposing the image bearing member of the second image forming station based on the information stored in the storage portion, and wherein when the usage amount of the image bearing member of the second image forming station is a first value, the exposure device forms the reverse electric field by exposing the image bearing member of the second image forming station with light at a first amount of exposure, and when the usage amount of the image bearing member of the second image forming station is a second value different from the first value, the exposure device forms the reverse electric field by exposing the image bearing member of the second image forming station with light at a second amount of exposure different from the first amount of exposure.

2. An image forming apparatus according to claim 1, wherein, when the reverse electric field is formed between the image bearing member and the transfer device of the second image forming station, the image bearing member is charged by the charging device in the second image forming station, and then exposed with light by the exposure device.

3. An image forming apparatus according to claim 1, further comprising a developer charging member configured to charge the developer adhering to the circulating member into a polarity opposite to a polarity established during image formation when the developer collecting operation is executed, wherein the control portion is configured to provide, when executing the developer collecting operation, one of the first and the second image forming stations as a collecting station which collects the developer and the other of the first and the second image forming stations as a non-collecting station which does not collect the developer and to form the reverse electric field in the non-collecting station.

4. An image forming apparatus according to claim 1, wherein the information stored in the storage portion comprises information based on at least one of a rotation time of the image bearing member, a number of sheets of the recording material on which images are formed by the image bearing member, and a time for which a voltage is applied to the charging device to charge the image bearing member.

5. An image forming apparatus according to claim 1, wherein, the control portion controls, when forming the reverse electric field in the second image forming station, the amount of exposure of the exposure device based on the information stored in the storage portion such that a potential difference between the image bearing member and the transfer device of the second image forming station for forming the reverse electric field is maintained at more than a predetermined value.

6. An image forming apparatus according to claim 1, wherein, the control portion increases, when forming the reverse electric field, an amount of an exposure for exposing the image bearing member of the second image forming station with an increase in the usage amount of the image bearing member of the second image forming station.

7. An image forming apparatus according to claim 6, wherein the control portion increases, when forming the reverse electric field, a power of the exposure for exposing the image bearing member of the second image forming station with an increase in the usage amount of the image bearing member of the second image forming station.

8. An image forming apparatus according to claim 7, wherein the control portion exposes, when forming the reverse electric field, a broader area of the image bearing member of the second image forming station with an increase in the usage amount of the image bearing member of the second image forming station.

9. An image forming apparatus according to claim 1, wherein the charging device provided in each of the first and the second image forming stations is applied with a voltage having the same value, and wherein the transfer device provided in each of the first and the second image forming stations is applied with a voltage having the same value.

10. An image forming apparatus according to claim 1, wherein at least the image bearing member and the cleaning device of one of the first and second image forming stations as well as the storage portion are integrally formed as a process cartridge which is removably mountable to a main body of the image forming apparatus.

11. An image forming apparatus according to claim 1, wherein the circulating member is an intermediate transfer member onto which the developer image is transferred from the image bearing member by the transfer device of each of the first and second image forming stations.

12. An image forming apparatus according to claim 11, further comprising a secondary transfer device configured to transfer the developer image transferred onto the intermediate transfer member onto the recording material.

13. An image forming apparatus according to claim 1, wherein the circulating member is a recording material conveying member which is configured to convey the recording material, and wherein the transfer device transfers the developer image from the image bearing member of each of the first and second image forming stations to the recording material.

* * * * *